US009454120B2

(12) United States Patent
Kanno et al.

(10) Patent No.: US 9,454,120 B2
(45) Date of Patent: Sep. 27, 2016

(54) IMAGE FORMING APPARATUS

(71) Applicant: CANON KABUSHIKI KAISHA, Tokyo (JP)

(72) Inventors: Naoki Kanno, Fujisawa (JP); Tadashi Fukumuro, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/878,197

(22) Filed: Oct. 8, 2015

(65) Prior Publication Data

US 2016/0033912 A1 Feb. 4, 2016

Related U.S. Application Data

(62) Division of application No. 13/962,230, filed on Aug. 8, 2013, now Pat. No. 9,195,196.

(30) Foreign Application Priority Data

Aug. 23, 2012 (JP) ..... 2012-184410

(51) Int. Cl.
*G03G 15/00* (2006.01)

(52) U.S. Cl.
CPC ..... *G03G 15/50* (2013.01); *G03G 15/6529* (2013.01); *G03G 15/6564* (2013.01); *G03G 2215/00721* (2013.01)

(58) Field of Classification Search
CPC ..... G03G 15/00; G03G 15/6529; G03G 15/6564; G03G 2215/00721
USPC ..... 399/394
See application file for complete search history.

(56) References Cited

U.S. PATENT DOCUMENTS

| | | | | |
|---|---|---|---|---|
| 6,311,039 | B1 * | 10/2001 | Funamizu | B65H 5/34 399/16 |
| 6,519,443 | B1 | 2/2003 | Coriale et al. | |
| 6,608,991 | B2 | 8/2003 | Takada | |
| 6,702,274 | B1 | 3/2004 | Otsuka | |
| 8,955,841 | B2 | 2/2015 | Endo | |
| 9,195,196 | B2 * | 11/2015 | Kanno | G03G 15/6529 |
| 2002/0025206 | A1 | 2/2002 | Takada | |
| 2008/0285988 | A1 | 11/2008 | Uchida et al. | |
| 2011/0064500 | A1 | 3/2011 | Takahashi | |
| 2011/0175281 | A1 | 7/2011 | Takahashi | |

FOREIGN PATENT DOCUMENTS

| | | |
|---|---|---|
| JP | 2000-19794 A | 1/2000 |
| JP | 2002-059601 A | 2/2002 |
| JP | 2005-75479 A | 3/2005 |
| JP | 2007-101666 A | 4/2007 |

* cited by examiner

*Primary Examiner* — Nguyen Ha
(74) *Attorney, Agent, or Firm* — Fitzpatrick, Cella, Harper & Scinto

(57) ABSTRACT

Provided is an image forming apparatus for driving a cassette pickup roller (17) and a registration roller (18) by using the same driving source, in which a conveyance control portion (221) starts conveyance speed control for a subsequent sheet, which is fed from a sheet feeding position subsequently to a preceding sheet fed therefrom earlier, when it is determined that a trailing edge of the preceding sheet has passed through the registration roller (18).

13 Claims, 14 Drawing Sheets

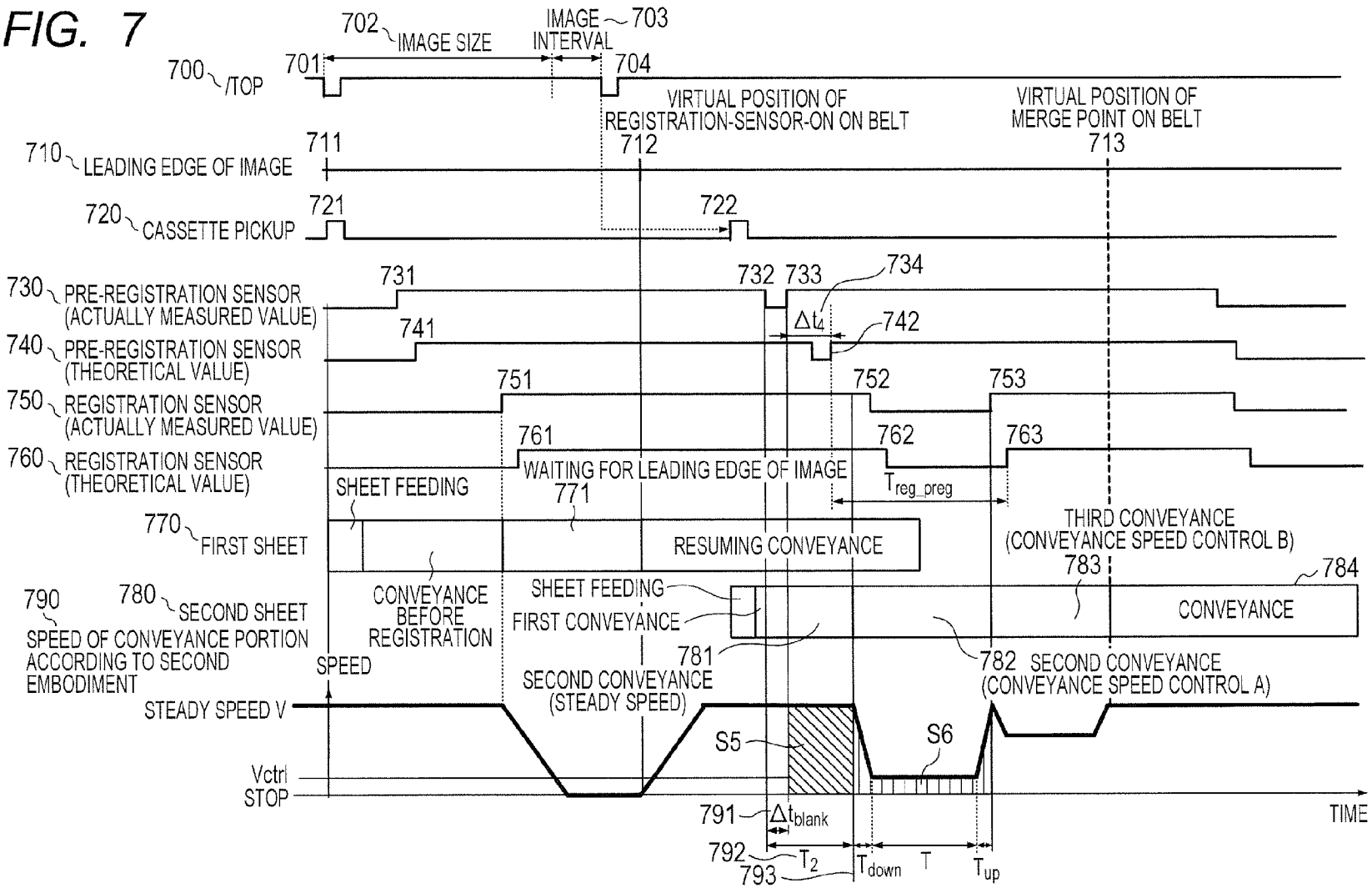
FIG. 7
700 ITOP
710 LEADING EDGE OF IMAGE
720 CASSETTE PICKUP
730 PRE-REGISTRATION SENSOR (ACTUALLY MEASURED VALUE)
740 PRE-REGISTRATION SENSOR (THEORETICAL VALUE)
750 REGISTRATION SENSOR (ACTUALLY MEASURED VALUE)
760 REGISTRATION SENSOR (THEORETICAL VALUE)
770 FIRST SHEET
780 SECOND SHEET
790 SPEED OF CONVEYANCE PORTION ACCORDING TO SECOND EMBODIMENT
SPEED
STEADY SPEED V
Vctrl
STOP
TIME
701
702 IMAGE SIZE
703 IMAGE INTERVAL
704
711
712 VIRTUAL POSITION OF REGISTRATION-SENSOR-ON ON BELT
713 VIRTUAL POSITION OF MERGE POINT ON BELT
721
722
731
732
733
734
741
742
751
752
753
761
762
763
771 SHEET FEEDING
WAITING FOR LEADING EDGE OF IMAGE
RESUMING CONVEYANCE
CONVEYANCE BEFORE REGISTRATION
SHEET FEEDING
FIRST CONVEYANCE
SECOND CONVEYANCE (STEADY SPEED)
781
782 SECOND CONVEYANCE (CONVEYANCE SPEED CONTROL A)
783 THIRD CONVEYANCE (CONVEYANCE SPEED CONTROL B)
784 CONVEYANCE
S5
S6
Δt1
Treg_preg
Tup
T
Tdown
T2
Δtblank
791
792
793

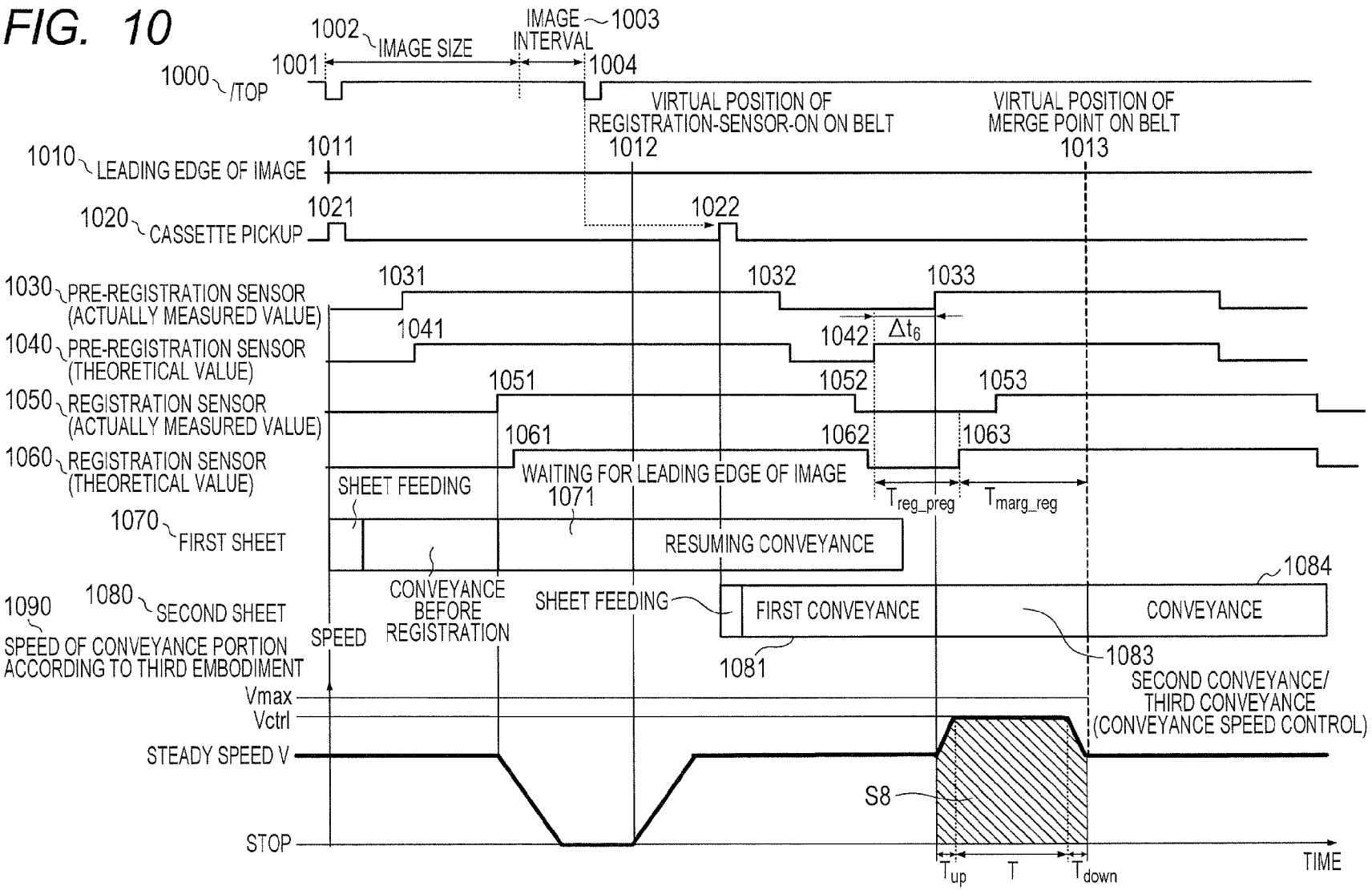
FIG. 10
1000 /TOP
1001
1002 IMAGE SIZE
1003 IMAGE INTERVAL
1004
1010 LEADING EDGE OF IMAGE
1011
1012 VIRTUAL POSITION OF REGISTRATION-SENSOR-ON ON BELT
1013 VIRTUAL POSITION OF MERGE POINT ON BELT
1020 CASSETTE PICKUP
1021
1022
1030 PRE-REGISTRATION SENSOR (ACTUALLY MEASURED VALUE)
1031
1032
1033
1040 PRE-REGISTRATION SENSOR (THEORETICAL VALUE)
1041
1042
Δt6
1050 REGISTRATION SENSOR (ACTUALLY MEASURED VALUE)
1051
1052
1053
1060 REGISTRATION SENSOR (THEORETICAL VALUE)
1061
1062
1063
1070 FIRST SHEET
1071
1080 SECOND SHEET
1081
1083
1084
1090 SPEED OF CONVEYANCE PORTION ACCORDING TO THIRD EMBODIMENT
SHEET FEEDING
WAITING FOR LEADING EDGE OF IMAGE
RESUMING CONVEYANCE
CONVEYANCE BEFORE REGISTRATION
SHEET FEEDING
FIRST CONVEYANCE
CONVEYANCE
SECOND CONVEYANCE/ THIRD CONVEYANCE (CONVEYANCE SPEED CONTROL)
SPEED
Vmax
Vctrl
STEADY SPEED V
STOP
TIME
Treg_preg
Tmarg_reg
Tup
T
Tdown
S8

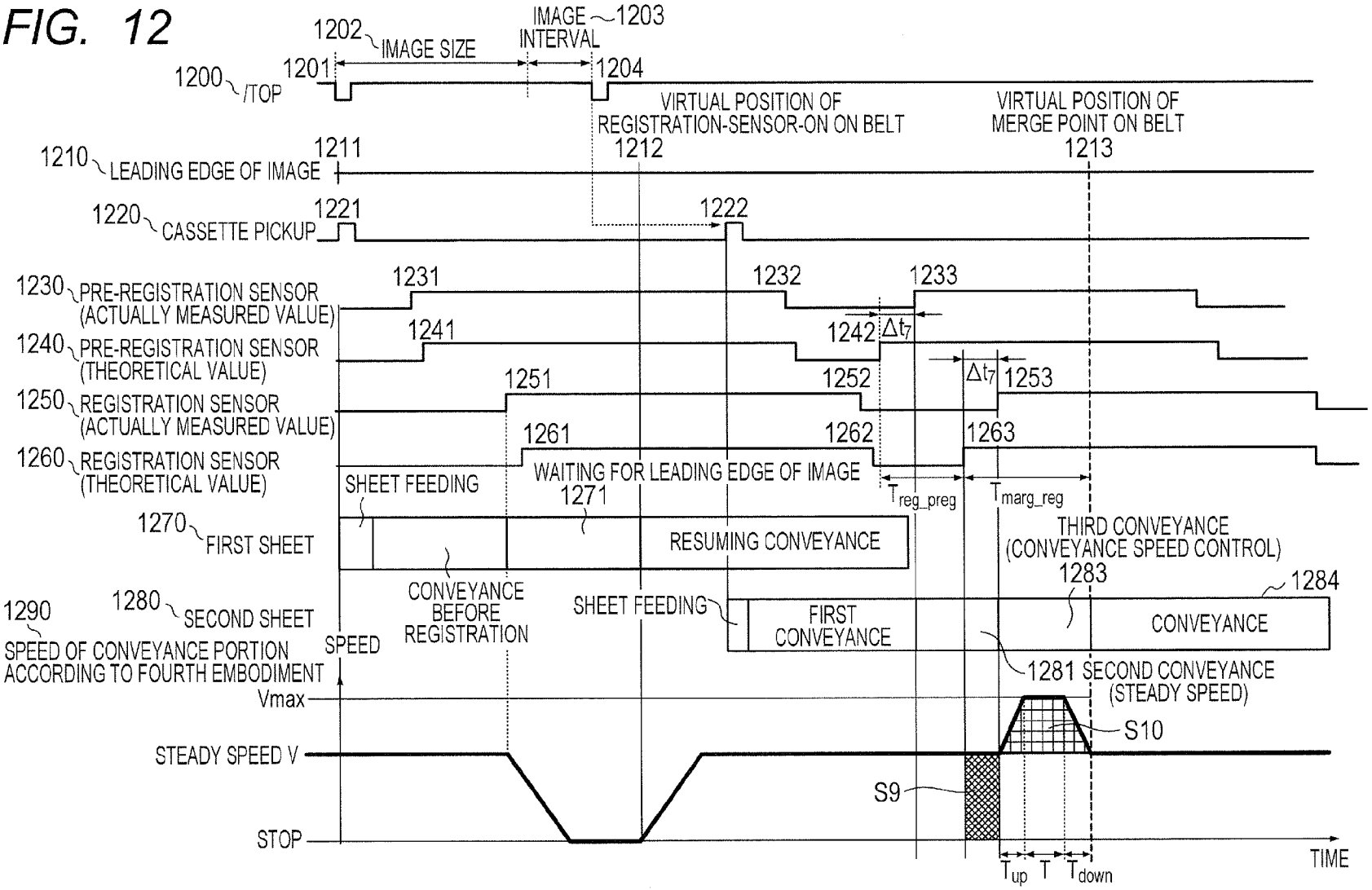
FIG. 12
1200 /TOP
1201
1202 IMAGE SIZE
1203 IMAGE INTERVAL
1204
1210 LEADING EDGE OF IMAGE
1211
1212 VIRTUAL POSITION OF REGISTRATION-SENSOR-ON ON BELT
1213 VIRTUAL POSITION OF MERGE POINT ON BELT
1220 CASSETTE PICKUP
1221
1222
1230 PRE-REGISTRATION SENSOR (ACTUALLY MEASURED VALUE)
1231
1232
1233
1240 PRE-REGISTRATION SENSOR (THEORETICAL VALUE)
1241
1242
1250 REGISTRATION SENSOR (ACTUALLY MEASURED VALUE)
1251
1252
1253
1260 REGISTRATION SENSOR (THEORETICAL VALUE)
1261
1262
1263
1270 FIRST SHEET
1271
1280 SECOND SHEET
1281 SECOND CONVEYANCE (STEADY SPEED)
1283 THIRD CONVEYANCE (CONVEYANCE SPEED CONTROL)
1284
1290 SPEED OF CONVEYANCE PORTION ACCORDING TO FOURTH EMBODIMENT
SHEET FEEDING
WAITING FOR LEADING EDGE OF IMAGE
RESUMING CONVEYANCE
CONVEYANCE BEFORE REGISTRATION
SHEET FEEDING
FIRST CONVEYANCE
CONVEYANCE
SPEED
Vmax
STEADY SPEED V
STOP
TIME
S9
S10
$\Delta t_7$
$T_{reg_preg}$
$T_{marg_reg}$
$T_{up}$
T
$T_{down}$

IMAGE FORMING APPARATUS

BACKGROUND OF THE INVENTION

1. Field of the Invention

The present invention relates to an image forming apparatus such as a copier and a laser printer.

2. Description of the Related Art

An image forming apparatus (for example, copier and printer) using an intermediate transfer member forms toner images on a photosensitive drum through a developing roller, and transfers the toner images onto the intermediate transfer member (hereinafter referred to as "primary transfer"). After that, the toner images are collectively transferred onto a recording material such as paper (hereinafter referred to as "secondary transfer"), to thereby obtain an image. In the image forming apparatus, in a case where the recording material is fed into the image forming apparatus and conveyed to a secondary transfer position, a slip occurs depending on an amount of stacked sheets inside a cassette, a doubly-fed amount due to a preceding sheet, an abrasion state of a sheet feeding roller, a type of media, or the like, to thereby cause a variation. The variation means that a sheet arrives at a predetermined position at a varied timing. When the variation occurs during conveyance of the recording material from a start of sheet feeding up to the arrival at the secondary transfer position, the toner image cannot be transferred onto an appropriate position of the recording material, and a high-quality image cannot be formed.

In a conventional technology, for example, the following control is performed. That is, a sheet detection sensor provided on a conveying path up to the secondary transfer position is used to measure a varied time period taken by the recording material being conveyed, and conveyance control is carried out based on the measured time period. Thereby, the control is performed so that the toner image is transferred onto the appropriate position of the recording material (see, for example, Japanese Patent Application Laid-Open No. 2007-101666). Specifically, the varied time period is compared with a reference time period without the variation, and a conveyance speed is increased or decreased based on a difference therebetween to convey the sheet up to the secondary transfer position. Under such control, it is possible to cancel the variation to obtain a satisfactory image. Such control is hereinafter referred to as "conveyance speed control".

In the conventional technology, a timing to carry out the conveyance speed control is determined only based on a timing at which the recording material is detected by the sheet detection sensor. In that case, for example, when recording materials are continuously conveyed in the image forming apparatus for conveying the recording material from the start of the sheet feeding up to the arrival at the secondary transfer position by using one driving source, the following case may occur. That is, when the conveyance speed control is carried out at the timing at which the record material is detected by the sheet detection sensor as in the conventional technology, there may be a change in the conveyance speed of the preceding sheet being subjected to the secondary transfer, which may hinder normal image formation. Therefore, in order to avoid affecting the conveyance of a preceding recording material, the conveyance speed is controlled by increasing a sheet feeding interval so as to constantly guarantee that a subsequent sheet arrives at the sheet detection sensor after the preceding sheet has passed through a conveyance portion located at the most downstream position among those operated by the same driving source. However, this control increases an interval of image formation, which lowers productivity of the image forming apparatus.

SUMMARY OF THE INVENTION

The present invention has been made in view of the above-mentioned circumstances, and an object thereof is to obtain a satisfactory image while suppressing a conveyance variation of a subsequent sheet without affecting conveyance of a preceding sheet or image formation thereof and without lowering productivity even when recording materials are continuously conveyed by the same driving source.

In order to achieve the above-mentioned object, the present invention is configured as follows.

According to one embodiment of the present invention, there is provided an image forming apparatus, including: a first conveyance portion feeding a recording material from a sheet feeding position to a conveying path; a first detection unit provided on a downstream side of the first conveyance portion in a conveying direction of the recording material and detecting one of a leading edge and a trailing edge of the recording material; a second conveyance portion provided on a downstream side of the first detection unit and conveying the recording material to a transfer position, and the first conveyance portion and the second conveyance portion being driven by the same driving source; a second detection unit provided on an upstream side of the transfer position and on a downstream side of the second conveyance portion and detecting one of the leading edge and the trailing edge of the recording material; a control unit controlling a conveyance speed of the recording material based on a result of detecting the recording material obtained by one of the first detection unit and the second detection unit so that a toner image on an image bearing member is transferred onto a predetermined position on the recording material in the transfer position; the first conveyance portion feeding a first recording material from the sheet feeding position precedingly, and then feeding a second recording material subsequently to the first recording material; and the control unit controlling a conveyance speed of the second recording material, after a trailing edge of the first recording material passes through the second conveyance portion, so as to be switched to a speed different from a speed of the second recording material at a time point when the first recording material passes through the second conveyance portion, in at least one of, a section from arrival of a leading edge of the second recording material at the first detection unit up to arrival of the leading edge of the second recording material at the second detection unit, and a section from the arrival of the leading edge of the second recording material at the second detection unit up to passing of the leading edge of the second recording material through the transfer position.

Further features of the present invention will become apparent from the following description of exemplary embodiments with reference to the attached drawings.

BRIEF DESCRIPTION OF THE DRAWINGS

FIG. 7 is a timing chart of conveyance speed control according to the second embodiment.

FIG. 10 is a timing chart of conveyance speed control (acceleration processing) according to the third embodiment.

FIG. 12 is a timing chart of conveyance speed control according to a fourth embodiment of the present invention.

DESCRIPTION OF THE EMBODIMENTS

Embodiments for carrying out the present invention are described below in detail.

First Embodiment

In a first embodiment of the present invention, a method performed by an image forming apparatus for conveying a sheet from a start of sheet feeding up to an arrival at a secondary transfer position by using one driving source in a case where two sheet detection sensors are provided between a sheet feeding position and the secondary transfer position (transfer position) and printing is continuously performed on two sheets is described as follows. That is, a method of carrying out conveyance speed control for a subsequent sheet based on a result of detecting a position of a preceding sheet being a recording material, which is obtained by the sheet detection sensor (hereinafter referred to as "downstream-side sheet detection sensor") on a downstream side in a conveying direction of the recording material (hereinafter referred to simply as "downstream side"), is described. The preceding sheet (first recording material) represents, when a given recording material is being conveyed on a conveying path, a recording material being conveyed immediately before the given recording material among the recording materials that are fed earlier than the given recording material and are being conveyed on the conveying path ahead of the given recording material. The subsequent sheet (second recording material) represents a recording material that is fed later than the preceding sheet and is being conveyed on the conveying path subsequently to the preceding sheet. That is, the given recording material is the subsequent sheet from the viewpoint of the preceding sheet. Of both edge portions in the conveying direction of the recording material being conveyed, the edge portion on the downstream side in the conveying direction is referred to as a leading edge, while the edge portion on an upstream side in the conveying direction is referred to as a trailing edge.

(Image Forming Apparatus)

Figure 1:
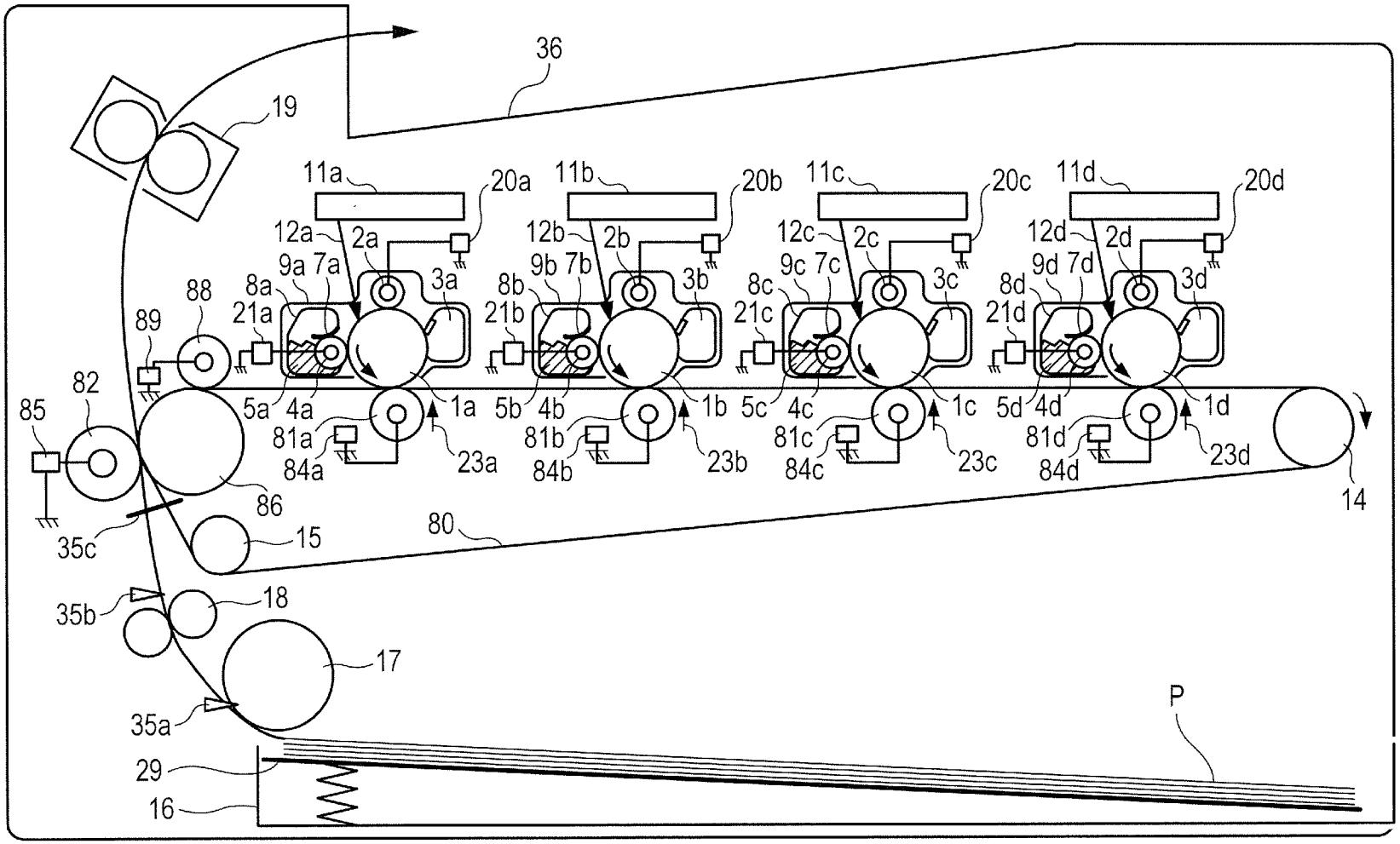
FIG. 1 is a diagram illustrating an overall structure of an image forming apparatus according to a first embodiment of the present invention.

FIG. 1 illustrates an overall structure of a laser printer serving as the image forming apparatus. In the following description, a first station is set as a station for forming a toner image in yellow (Y) and includes components denoted by a suffix "a", while a second station is set as a station for forming a toner image in magenta (M) and includes components denoted by a suffix "b". A third station is set as a station for forming a toner image in cyan (C) and includes components denoted by a suffix "c", while a fourth station is set as a station for forming a toner image in black (K) and includes components denoted by a suffix "d".

(Image Forming Portion)

The first station is described. A photosensitive drum 1*a* has a metallic cylinder whose surface is laminated with a plurality of layers of functional organic materials formed of a carrier generation layer that senses light to generate a charge, a charge transporting layer for transporting the generated charge, and the like. An outermost layer of the photosensitive drum 1*a* is substantially insulated due to a low electric conductivity. The photosensitive drum 1*a* is formed of, for example, an aluminum cylinder having an outer peripheral surface coated with an organic photoconductor (OPC) layer. Both end portions of the photosensitive drum 1*a* are supported by flanges so as to freely rotate, and a driving force is transmitted from a driving motor (not shown) to one of the end portions, to thereby rotationally drive the photosensitive drum 1*a* counterclockwise in FIG. 1. A charging roller 2*a* serving as a charging unit abuts against the photosensitive drum 1*a*, and uniformly charges the surface of the photosensitive drum 1*a* while being rotated following rotation of the photosensitive drum 1*a*. The charging roller 2*a* is a conductive roller formed to have a roller shape, and uniformly charges the surface of the photosensitive drum 1*a* by abutting against the surface of the photosensitive drum 1*a* and applying a charging voltage thereto from a charging voltage source 20*a*. A direct current voltage or a voltage obtained by superposing an alternating current voltage on a direct current voltage is applied to the charging roller 2*a*, and discharge occurs from an abutment nip portion between the charging roller 2*a* and the surface of the photosensitive drum 1*a* due to minute air gaps on the upstream side and the downstream side, thereby charging the photosensitive drum 1*a*.

A cleaning unit 3*a* removes toner (hereinafter referred to as "transfer residual toner") remaining on the photosensitive drum 1*a* after transfer. A developing unit 8*a* serving as a unit for development includes a developing roller 4*a* abutting against the photosensitive drum 1*a*, a non-magnetic one-component developer (hereinafter referred to as "toner") 5*a*, and a developer applying blade 7*a*. The developing units 8*a* to 8*d* include a toner receiving portion for receiving the toner in the respective colors of yellow, magenta, cyan, and black, respectively. The developing roller 4*a* is adjacent to the surface of the photosensitive drum 1*a*, and performs development by applying a developing voltage through a developing voltage source 21*a* while being rotationally driven by a drive portion (not shown). The photosensitive drum 1*a* to the developing unit 8*a* are formed into an integral process cartridge 9*a* that is removably mounted to the image forming apparatus.

An exposure device 11*a* serving as an exposing unit includes a rotary polygonal mirror (not shown), and the rotary polygonal mirror is irradiated with image light corresponding to an image signal by a laser diode (not shown).

The exposure device 11*a* includes an LED array or a scanner unit for scanning laser light by using the rotary polygonal mirror, and irradiates the surface of the photosensitive drum 1*a* with a scan beam 12*a* modulated based on the image signal.

The charging roller 2*a* is connected to the charging voltage source 20*a* serving as a unit for supplying a voltage to the charging roller 2*a*. The developing roller 4*a* is connected to the developing voltage source 21*a* serving as a unit for supplying a voltage to the developing roller 4*a*. A primary transfer roller 81*a* is connected to a primary transfer voltage source 84*a* serving as a unit for supplying a voltage to the primary transfer roller 81*a*. The structure of the first station has been described above. The second station, the third station, and the fourth station also have the same structure as the first station, and the same components thereof as those of the first station are denoted by the same reference symbols except that the suffix "a" is substituted by "b", "c", and "d", respectively, while omitting descriptions thereof.

On an inner side of an intermediate transfer belt (image bearing member), the primary transfer rollers 81*a* to 81*d* abutting against the intermediate transfer belt 80 are provided side by side so as to be opposed to four photosensitive drums 1*a* to 1*d*, respectively. The primary transfer rollers 81*a* to 81*d* are connected to the primary transfer voltage sources 84*a* to 84*d*, respectively. A voltage having a positive polarity is applied to the primary transfer rollers 81*a* to 81*d*, and toner images having a negative polarity in the respective colors on the photosensitive drums 1*a* to 1*d* are sequentially transferred onto the intermediate transfer belt 80 being in contact with the photosensitive drums 1*a* to 1*d*, respectively, to thereby form a multicolor image.

The intermediate transfer belt 80 is supported by three rollers of a secondary transfer opposing roller 86, a drive roller 14, and a tension roller 15 that serve as tension members, and an appropriate tension is maintained. By driving the drive roller 14, the intermediate transfer belt 80 moves at substantially the same speed in a forward direction relative to the photosensitive drums 1*a* to 1*d*. Further, the intermediate transfer belt 80 rotates in a direction indicated by the arrow (clockwise), and the primary transfer roller 81*a* is arranged on the opposite side to the photosensitive drum 1*a* with the intermediate transfer belt 80 being disposed therebetween. A charge eliminating member 23*a* is arranged on a downstream side of the primary transfer roller 81*a* in a rotational direction of the intermediate transfer belt 80. The drive roller 14, the tension roller 15, the charge eliminating member 23*a*, and the secondary transfer opposing roller 86 are electrically grounded. The suffixes to are "a" to "d" are hereinafter omitted unless necessary.

The multicolor image formed on the intermediate transfer belt 80 (on the image bearing member) is transferred onto a recording material P by a secondary transfer roller 82 in synchronization with the recording material P fed and conveyed from a feeding portion described later (this transfer is referred to also as "secondary transfer"). The toner remaining on the intermediate transfer belt 80 without being transferred onto the recording material P is removed by a belt cleaning roller 88 to which a voltage is applied by a cleaning voltage source 89.

(Feeding Portion)

When a sheet is fed from a main body cassette 16, a cassette pickup roller 17 (first conveyance portion) is driven, while a main body cassette basal plate 29 rises to push up recording materials P placed inside the main body cassette 16. The uppermost one of the recording materials P that have been pushed up is brought into abutment against the cassette pickup roller 17, the recording materials P are separated and fed one by one by the rotation of the cassette pickup roller 17, and conveyed to a registration roller 18 (second conveyance portion). The cassette pickup roller 17 and the registration roller 18 are driven to rotate by the same driving source (not shown) (such as stepping motor) to convey the recording material P. A pre-registration sensor 35*a* (first detection unit) and a registration sensor 35*b* (second detection unit), which are sheet detection sensors for detecting the recording material P, are respectively placed on the conveying path. In this embodiment, for example, the pre-registration sensor 35*a* is placed on a downstream side of the cassette pickup roller 17, and the registration sensor 35*b* is placed on a downstream side of the registration roller 18. With this arrangement, at a timing at which the trailing edge of the recording material P is detected by the pre-registration sensor 35*a*, it is guaranteed that the trailing edge of the recording material P has passed through the cassette pickup roller 17. In the same manner, at a timing at which the trailing edge of the recording material P is detected by the registration sensor 35*b*, it is guaranteed that the trailing edge of the recording material P has passed through a nip portion formed by the registration roller 18.

The pre-registration sensor 35*a* and the registration sensor 35*b* output a low-level signal when, for example, the recording material P is not being detected. When the leading edge of the recording material P arrives at the pre-registration sensor 35*a* and the registration sensor 35*b*, for example, outputs from those sensors rise, and a high-level signal is output. The pre-registration sensor 35*a* and the registration sensor 35*b* keep outputting the high-level signal while, for example, the recording material P is passing therethrough. After the trailing edge of the recording material P has passed therethrough, outputs from those sensors drop, and the low-level signal is output. A signal output from a sensor depending on presence/absence of the recording material P is not limited to that in the above-mentioned configuration, and any signal that can distinguish arrival of the leading edge of the recording material P and passage of the trailing edge thereof may be employed.

(Recording Material Conveyance Control)

The fed recording material P is conveyed by the registration roller 18, and after a leading edge of the image and the leading edge of the recording material are synchronized with each other in a position 35*c*, conveyed to a secondary transfer portion. The position 35*c* is hereinafter referred to as "merge point". The intermediate transfer belt 80, which constitutes the secondary transfer portion, is stretched around and supported by the three rollers of the secondary transfer opposing roller 86, the drive roller 14, and the tension roller 15, and is arranged so as to be opposed to all the photosensitive drums 1*a* to 1*d*. The intermediate transfer belt 80 is moved in a loop by the drive roller 14, and the toner image is electrostatically attracted to its outer peripheral surface opposed to the photosensitive drum 1. With this configuration, the multicolor image is formed on an outer periphery of the intermediate transfer belt 80, and the image formed on the intermediate transfer belt 80 is conveyed to an abutment portion (secondary transfer portion) between the secondary transfer roller 82 and the intermediate transfer belt 80, which is the secondary transfer position.

In the conveyance of the recording material P, by using a secondary transfer voltage source 85 to apply a voltage to the secondary transfer roller 82, an electric field is formed between the secondary transfer roller 82 and the secondary transfer opposing roller 86 placed so as to be opposed thereto. Then, an electrostatic attraction force is generated between the intermediate transfer belt and the recording material P by generating dielectric polarization therebetween.

(Fixing Portion)

A fixing device 19 serving as a fixing unit fixes the toner image by applying heat and pressure to the image formed on the recording material, and includes a fixing belt (not shown) and an elastic pressure roller (not shown). The elastic pressure roller forms a fixing nip portion having a predetermined width by applying a predetermined press-contact force to a belt guide member (not shown) across the fixing belt. In a state in which the fixing nip portion is subjected to temperature control after rising to a predetermined temperature, the recording material P on which an unfixed toner image is formed is conveyed from the image forming portion to be introduced between the fixing belt and the elastic pressure roller in the fixing nip portion with the image surface facing downward, that is, being opposed to a surface of the fixing belt. In the fixing nip portion, with the image surface in close contact with an outer surface of the fixing belt, the recording material P is subjected to nip conveyance through the fixing nip portion together with the fixing belt. In the course in which the recording material P is nipped and conveyed through the fixing nip portion together with the fixing belt, the recording material is heated by the fixing belt, and the unfixed toner image thereon is heated and fixed. The recording material P that has been fixed is delivered to a delivery tray 36.

(System Configuration of Image Forming Apparatus)

Figure 2:
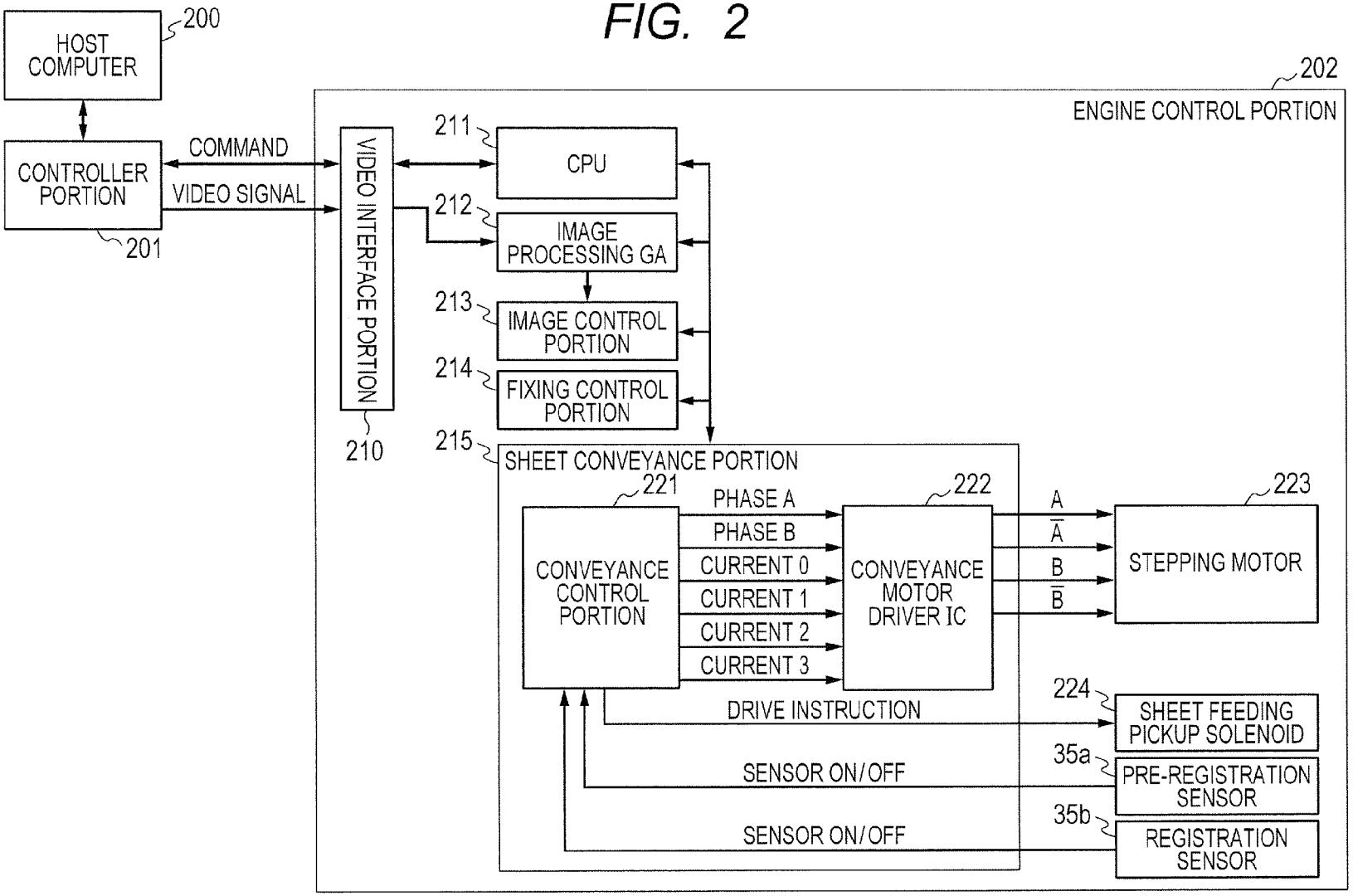
FIG. 2 is a diagram illustrating a system configuration of the image forming apparatus according to the first embodiment.

FIG. 2 is a block diagram for illustrating an overall system configuration of the image forming apparatus. A controller portion 201 can mutually communicate to/from a host computer 200 and an engine control portion 202. The controller portion 201 receives image information and a print command from the host computer 200, and analyzes the received image information to convert the image information into bit data. Then, the controller portion 201 transmits a print booking command, a print start command, and a video signal to a CPU 211 and an image processing GA 212 via a video interface portion 210 for each recording material.

The controller portion 201 transmits the print booking command to the CPU 211 via the video interface portion 210 in response to the print command received from the host computer 200, and at a timing at which a printable state is reached, transmits the print start command to the CPU 211. The CPU 211 prepares to execute printing in an order in which the print booking commands are received from the controller portion 201, and waits for the print start command to be received from the controller portion 201. When receiving the print start command, the CPU 211 instructs the respective control portions (image control portion 213, fixing control portion 214, and sheet conveyance portion 215) to start the printing operation based on information on the print booking command.

When the instruction to start the printing operation has been received, the image control portion 213 starts to prepare for image formation. When notified from the image control portion 213 that the image formation is ready, the CPU 211 outputs a /TOP signal, which serves as a reference timing to output the video signal, to the controller portion 201. When receiving the /TOP signal from the CPU 211, the controller portion 201 outputs the video signal by using the /TOP signal as a reference. When receiving the video signal from the controller portion 201, the image processing GA 212 transmits image formation data to the image control portion 213. The image control portion 213 forms an image based on the image formation data received from the image processing GA 212.

When the instruction to start the printing operation has been received, the sheet conveyance portion 215 starts a sheet feeding operation. A conveyance control portion 221 of the sheet conveyance portion 215 rotates a stepping motor 223 via a conveyance motor driver IC 222. The conveyance control portion 221 instructs a sheet feeding pickup solenoid 224 to start driving (indicated in the figure as "drive instruction") at a timing at which the sheet is picked up, and rotates the cassette pickup roller 17. The conveyance control portion 221 detects the position of the recording material based on output results from the pre-registration sensor 35*a* and the registration sensor 35*b* (indicated in the figure as "sensor ON/OFF"), and conveys the recording material to the secondary transfer position while carrying out the conveyance speed control.

When the instruction to start the printing operation has been received, the fixing control portion 214 starts to prepare for fixation. The fixing control portion 214 starts controlling the temperature based on the information of the print booking command in synchronization with the conveyance of the recording material subjected to the secondary transfer. The fixing control portion 214 fixes the image to the recording material, and conveys the recording material to an outside of the apparatus.

(Conventional Conveyance Speed Control)

Figure 3A:
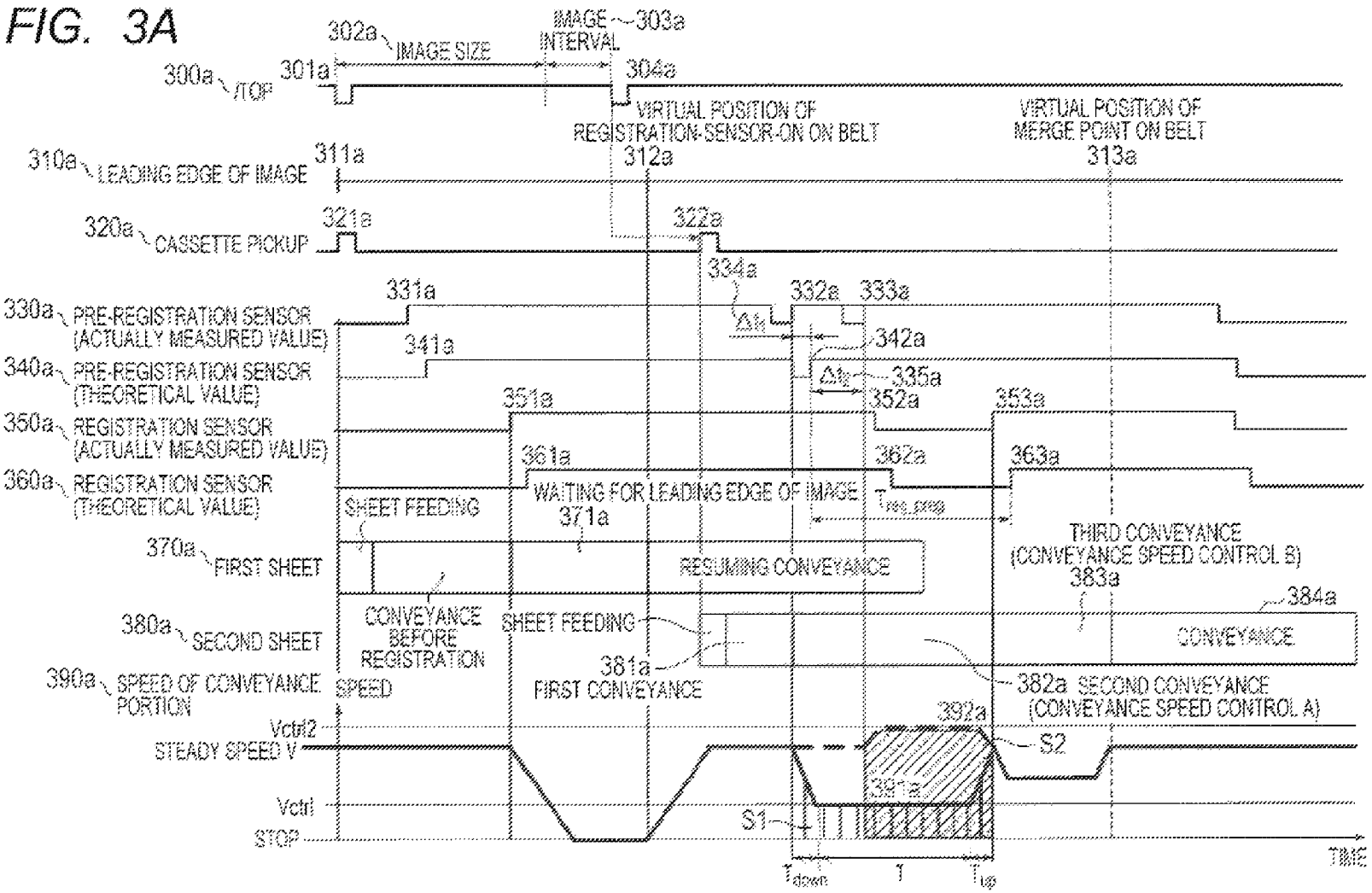
PRIOR ART FIG. 3A
FIG. 3A is a timing chart of conventional conveyance speed control (with separate driving) for the purpose of comparison with the first embodiment.
Figure 3B:
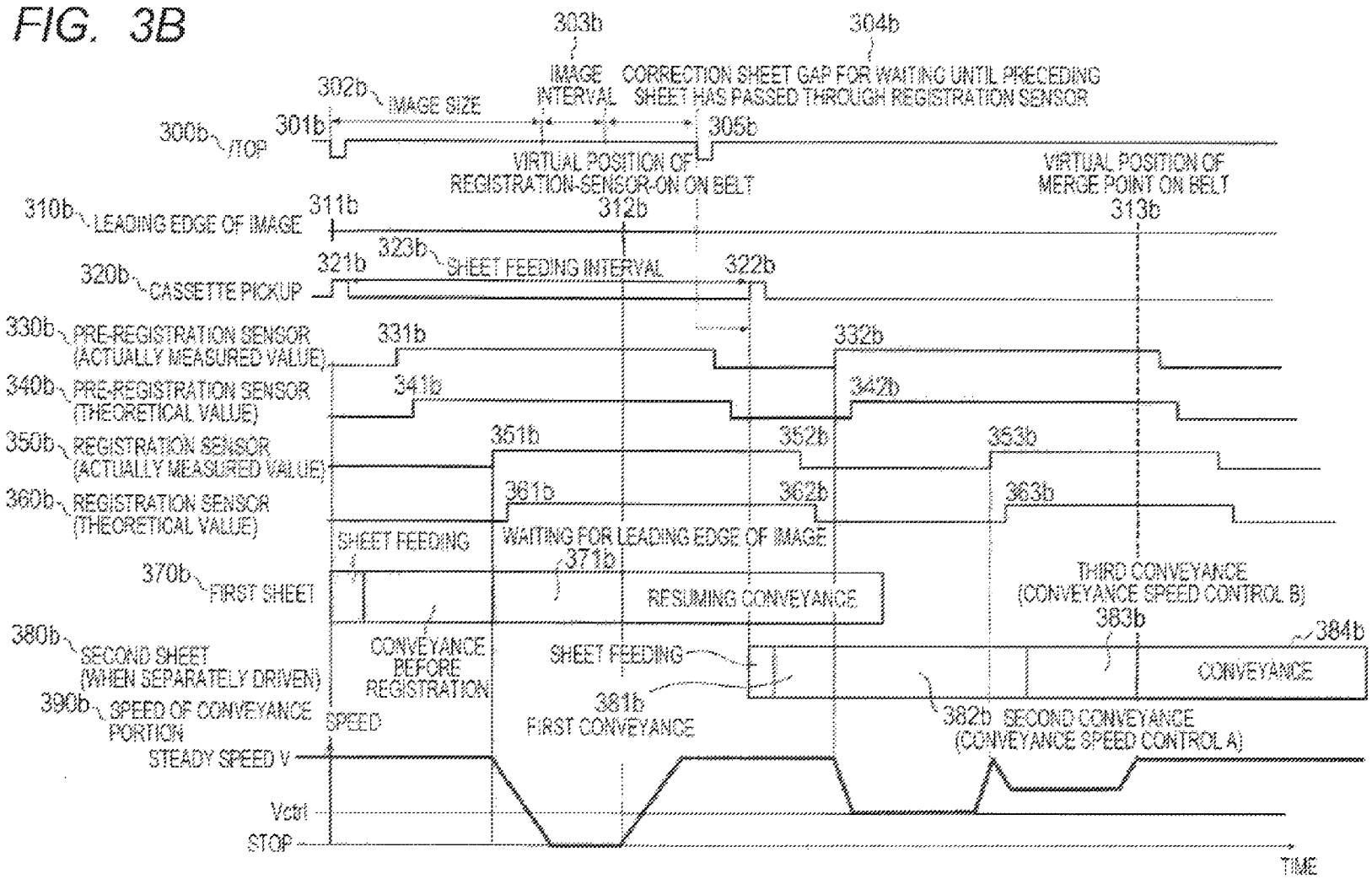
FIG. 3B PRIOR ART
FIG. 3B is a timing chart of conventional conveyance speed control (with the same driving) for the purpose of comparison with the first embodiment.

FIGS. 3A and 3B are timing charts illustrating conventional conveyance speed control for the purpose of comparison with this embodiment. FIG. 3A is the timing chart in a case where the cassette pickup roller 17 and the registration roller 18 are driven to rotate by separate driving sources (such as stepping motors). FIG. 3B is the timing chart in a case where the cassette pickup roller 17 and the registration roller 18 are driven to rotate by the same driving source.

FIGS. 3A and 3B illustrate, from the top, an output timing of the /TOP signal (300*a*), an arrival timing of the leading edge of the image (310*a*) in each position, and a timing to drive the cassette pickup roller 17 (320*a*) (indicated in the figure as "cassette pickup"). Subsequently, FIGS. 3A and 3B illustrate an actually measured value (330*a*) of the output timing of the pre-registration sensor 35*a*, a theoretical value (340*a*) of the output timing of the pre-registration sensor 35*a*, an actually measured value (350*a*) of the output timing of the registration sensor 35*b*, and a theoretical value (360*a*) of the output timing of the registration sensor 35*b*. In addition, FIGS. 3A and 3B illustrate a status (370*a*) of the first recording material (first sheet), a status (380*a*) of the second recording material (second sheet), and a speed (390*a*) of a conveyance portion. The conveyance portion includes the cassette pickup roller 17 and the registration roller 18. An actually measured value of the output timing of each sensor is measured by, for example, starting a timer (not shown) at a timing at which the CPU 211 outputs the /TOP signal. A theoretical value of the output timing of each sensor is, for example, stored in advance in a memory (not shown) or the like. The same applies to the following description.

(Case of Separate Driving Sources (FIG. 3A))

A description is made with reference to FIG. 3A. The CPU 211 outputs the /TOP signal corresponding to the first recording material (hereinafter referred to simply as "first sheet") (301*a*), and starts the image forming operation (311*a*) corresponding to the first sheet. Further, the CPU 211 instructs the sheet conveyance portion 215 to start the printing operation, and the conveyance control portion 221 of the sheet conveyance portion 215 starts the sheet feeding operation (321*a*) by using the cassette pickup roller 17 (indicated in the figure as "sheet feeding" in the status 370*a* of the first sheet). The conveyance control portion 221 conveys the first sheet until a timing (351*a*) to arrive at the registration sensor 35*b* (indicated in the figure as "conveyance before registration" in the status 370*a* of the first sheet). An actually measured value 331*a* represents the actually measured value of a timing at which the first sheet arrives at the pre-registration sensor 35*a*, and a theoretical value 341*a* represents the theoretical value of the timing at which the first sheet arrives at the pre-registration sensor 35*a*. At this time, it is assumed that a conveyance speed of the recording material controlled by the sheet conveyance portion 215 is a steady-state speed (steady speed) V. At a timing (351*a*) at which the leading edge of the recording material (referred to as "sheet leading edge") arrives at the registration sensor 35*b*, the conveyance control portion 221 stops conveyance control (indicated in the figure as "waiting for leading edge of image" 371*a* in the status 370*a* of the first sheet). At this time, the sheet conveyance portion 215 controls the conveyance speed of the recording material to decrease from the steady speed V to zero (stop). In synchronization with the image formed on the intermediate transfer belt 80, that is, at a timing at which the leading edge of the image (310*a*) arrives at a position 312*a*, the conveyance control portion 221 resumes the conveyance control for the first recording material whose conveyance has been stopped at the registration sensor 35*b* (312*a*). It is indicated in the figure as "virtual position of registration-sensor-on on belt" 312*a*. The "virtual position of registration-sensor-on on belt" represents such a position that a time period taken by the leading edge of the image to arrive at the secondary transfer portion from the position on the intermediate transfer belt 80 is equal to a time period taken by the leading edge of the recording material to arrive at the secondary transfer portion from the position of the registration sensor 35*b*. The speed of the sheet conveyance portion 215 increases from zero to become the steady speed V (indicated in the figure as "resuming conveyance" in the status 370*a* of the first sheet).

The CPU 211 outputs the /TOP signal of the second sheet after a time period corresponding to (image size (302*a*))+(margin between images (image interval (303*a*))) has elapsed since the output timing (301*a*) of the /TOP signal of the first sheet (304*a*). The image size (302*a*) is a size of the toner image in the conveying direction. The image interval (303*a*) is an interval between a trailing edge of the toner image corresponding to the first sheet and the leading edge of the toner image corresponding to the second sheet in the case where the toner image is formed on the intermediate transfer belt 80.

The conveyance control portion 221 starts the sheet feeding operation for the second sheet at a sheet feeding timing (322*a*) determined from the output timing (304*a*) of the /TOP signal of the second sheet (indicated in the figure as "sheet feeding" in the status 380*a* of the second sheet). When the sheet leading edge of the second sheet arrives at the pre-registration sensor 35*a* (332*a*), the conveyance control portion 221 calculates a difference time period $\Delta t_1$ (334*a*) between a theoretical value (342*a*) of a pre-registration sensor arrival timing and an actually measured value (332*a*) thereof. Here, the theoretical value represents a timing assumed in a case where the recording material is conveyed from the start of the sheet feeding to the arrival at the pre-registration sensor 35*a* without a variation. The conveyance control portion 221 carries out the conveyance speed control so that the difference time period $\Delta t_1$ can be canceled before the arrival at the registration sensor 35*b* (conveyance speed control A (382*a*)) (indicated in the figure as "second conveyance (conveyance speed control A)" in the status 380*a* of the second sheet).

Now, the conveyance speed control A is described in detail. For example, the conveyance speed is decreased (391*a* (solid line)) when the sheet leading edge of the subsequent sheet arrives at the pre-registration sensor 35*a* earlier than the theoretical value ((theoretical value (342*a*))> (actually measured value (332*a*))) because the subsequent sheet is doubly fed by the preceding sheet. In contrast, when the sheet leading edge of the subsequent sheet arrives at the pre-registration sensor 35*a* later than the theoretical value ((theoretical value (342*a*))<(actually measured value (333*a*))) due to a slip between the cassette pickup roller 17 and the sheet, the following operation is performed. That is, the conveyance speed is increased (392*a* (broken line)), and the speed is returned to a steady speed immediately before the arrival at the registration sensor. A method of calculating the speed for conveying the recording material by the conveyance speed control A is described below.

For example, in the case of decreasing the conveyance speed (391*a* (solid line)), assuming that:

$T_{reg_prep}$ is a time period (a theoretical value) taken between the pre-registration sensor 35*a* and the registration sensor 35*b;*

$\Delta t_1$ is a difference time period (334*a*) between the theoretical value (342*a*) of the pre-registration sensor and the actually measured value (332*a*) thereof;

$T_{down}$ is a time period required to decrease the conveyance speed from the steady speed V to a conveyance speed controlling speed $V_{ctrl}$;

$T_{up}$ is a time period required to increase the conveyance speed from the conveyance speed controlling speed $V_{ctrl}$ to the steady speed V; and T is a time period during which the recording material is conveyed at the conveyance speed controlling speed $V_{ctrl}$, a time period for carrying out the conveyance speed control is expressed as the following expression.

$$T_{reg_preg}+\Delta t_1=T_{down}+T+T_{up} \quad \text{(Expression 1)}$$

Further, assuming that:

V is a steady speed;

$V_{ctrl}$ is a conveyance speed controlling speed; and

S1 is a recording material conveyance distance of the leading edge of the recording material from arrival at the pre-registration sensor 35*a* up to arrival at the registration sensor 35*b,* a section (distance) for carrying out the conveyance speed control establishes the following expression.

$$S1=((V+V_{ctrl})\times T_{down})/2+(T\times V_{ctrl})+((V+V_{ctrl})\times T_{up})/2 \quad \text{(Expression 2)}$$

S1 is the same as the conveyance distance ($=T_{reg_preg}\times V$) in the case where the leading edge of the recording material arrives at the pre-registration sensor 35*a* and the registration sensor 35*b* at ideal timings (that is, the recording material is conveyed at the steady-state speed V without the conveyance speed control), and hence the following expression is established.

$$T_{reg_preg}\times V=((V+V_{ctrl})\times T_{down})/2+(T\times V_{ctrl})+((V+V_{ctrl})\times T_{up})/2 \quad \text{(Expression 3)}$$

Here, assuming that an acceleration applied when the stepping motor is accelerated and decelerated is g, the following expression is established.

When the stepping motor is decelerated:

$$V_{ctrl}=V-g\times T_{down} \quad \text{(Expression 4)}$$

When the stepping motor is accelerated:

$$V=V_{ctrl}+g\times T_{up} \quad \text{(Expression 5)}$$

The conveyance speed control A is carried out by calculating $V_{ctrl}$ and T from (Expression 1) to (Expression 5). The acceleration g differs depending on characteristics of the stepping motor, the control method thereof, or the like. Therefore, information on the acceleration g is retained in the memory (not shown) of the CPU 211 in advance and output from the CPU 211 to the conveyance control portion 221. The conveyance control portion 221 may include the memory (not shown), and the information on the acceleration g may be retained in the memory (not shown) in advance.

In the case of increasing the conveyance speed (392*a*), the arrival timing of the second sheet at the pre-registration sensor 35*a* is assumed as a timing of 333*a* (broken line) as the actually measured value.

Assuming that $\Delta t_1$ is a difference time period (335*a*) between the theoretical value of the pre-registration sensor and the actually measured value thereof, the following expression is established.

$$T_{reg_prep}-\Delta t_1-T_{up}+T+T_{down} \quad \text{(Expression 6)}$$

Assuming that:

$V_{ctrl2}$ is a conveyance speed controlling speed; and

S2 is a recording material conveyance distance of the leading edge of the recording material from arrival at the pre-registration sensor 35*a* up to arrival at the registration sensor 35*b*, a section (distance) for carrying out the conveyance speed control establishes the following expression.

$$S2=(V+V_{ctrl2})\times T_{up})/2+(T\times V_{ctrl2})+(V+V_{ctrl2})\times T_{down})/2 \quad \text{(Expression 7)}$$

S2 is the same as the conveyance distance ($=T_{reg_preg}\times V$) in the case where the leading edge of the recording material arrives at the pre-registration sensor 35*a* and the registration sensor 35*b* at ideal timings (that is, the recording material is conveyed at the steady-state speed V without the conveyance speed control), and hence the following expression is established.

$$T_{reg_preg}\times V=(V+V_{ctrl2})\times T_{up})/2+(T\times V_{ctrl2})+((V+V_{ctrl2})\times T_{down})/2 \quad \text{(Expression 8)}$$

The conveyance speed control A is carried out by calculating $V_{ctrl2}$ and T from (Expression 4) to (Expression 8).

The conveyance speed control A cancels a variation of the pre-registration sensor arrival timing caused in the case where the recording material is conveyed from a sheet-feeding start position to the pre-registration sensor 35*a*. Examples of the sheet-feeding start position include the position of a leading edge portion of the recording material P stacked on the top of the main body cassette 16 and a nip portion being the position in which the cassette pickup roller 17 is brought into contact with the conveying path. The variation of the pre-registration sensor arrival timing is caused by an amount of stacked sheets, a doubly-fed amount due to the preceding sheet, and a slip between the cassette pickup roller 17 and the sheet (hereinafter referred to as "variation in sheet feeding").

After that, when the sheet leading edge of the second sheet arrives at the registration sensor 35*b*, the conveyance control portion 221 calculates a difference time period between a theoretical value (363*a*) of a registration sensor arrival timing and an actually measured value (353*a*) thereof. The conveyance control portion 221 carries out the conveyance speed control so that this difference can be canceled before the arrival (313*a*) at the merge point 35*c* (conveyance speed control B (383*a*)) (indicated in the figure as "third conveyance (conveyance speed control B)" in the status 380*a* of the second sheet).

The conveyance speed control B is performed in the same manner as the conveyance speed control A described above. After that, the conveyance control portion 221 returns the conveyance speed to the steady speed V (313*a*) before the sheet leading edge arrives at the merge point 35*c* (indicated in the figure as "virtual position of merge point on belt" in 310*a*).

The conveyance speed control B cancels a variation in the registration sensor arrival timing caused in the case where the recording material is conveyed from the pre-registration sensor 35*a* to the registration sensor 35*b*. In the case where the recording material is conveyed to the registration roller 18 by the cassette pickup roller 17, the recording material is not nipped by conveyance rollers, and hence a slip depending on a surface condition of the recording material and a variation relating to a sheet feeding roller (abrasion state) occurs (hereinafter referred to as "conveyance variation (slip)"). The variation in the registration sensor arrival timing occurs due to this conveyance variation (slip).

After that, the conveyance control portion 221 conveys the recording material at the steady speed V after the sheet leading edge arrives at the merge point 35*c*, the fixing control portion 214 fixes the image thereto, and the recording material is delivered to the outside of the apparatus (384*a*) (indicated in the figure as "conveyance" in the status 380*a* of the second sheet). A status 381*a* indicates that the second sheet 380*a* is in first conveyance. The "first conveyance" is a status between the sheet feeding and the arrival at the registration sensor 35*b*. An actually measured value 352*a* is an actually measured value of a timing at which the trailing edge of the first sheet passes through the registration sensor 35*b*, a theoretical value 361*a* is a theoretical value of a timing at which the leading edge of the first sheet arrives at the registration sensor 35*b*, and a theoretical value 362*a* is a theoretical value of a timing at which the trailing edge of the first sheet passes through the registration sensor 35*b*.

In the conventional example illustrated in FIG. 3A, as described above, the cassette pickup roller 17 and the registration roller 18 are respectively driven to rotate by the separate driving source (such as stepping motor) to convey the recording material. Therefore, the conveyance speed control for the subsequent sheet does not affect the conveyance control for the preceding sheet.

(Case of the Same Driving Source)

FIG. 3B is a timing chart of the conventional conveyance speed control in the case where the cassette pickup roller 17 and the registration roller 18 are driven to rotate by the same driving source (such as stepping motor) to convey the recording material. The description of the same control as that of FIG. 3A is omitted, and the difference from the control described with reference to FIG. 3A is described. In FIG. 3B, the suffix "b" is added to reference symbols corresponding to those of FIG. 3A instead of the suffix "a".

In FIG. 3B, the cassette pickup roller 17 and the registration roller 18 are driven to rotate by the same driving source (such as stepping motor) to convey the recording material. Therefore, as described with reference to FIG. 3A, the conveyance speed control carried out for the subsequent sheet being the second sheet at the pre-registration sensor arrival timing (actually measured value 332*a* or 333*a* in FIG. 3A) affects the conveyance of the preceding sheet being the first sheet. This is because, in the case where the cassette pickup roller 17 and the registration roller 18 are driven to rotate by the same driving source, the registration roller 18 being driven by the same driving source is changed in the speed. That is, the conveyance speed control A indicated in the status 382*a* of FIG. 3A is started before the timing 352*a* at which the trailing edge of the first sheet passes through the registration sensor 35*b*. As a result, the driving that uses the same driving source affects the first sheet being conveyed by the registration roller 18.

As illustrated in the example of FIG. 3B, a sheet feeding interval (323*b*) needs to be increased in advance (304*b*) so that the trailing edge of the preceding sheet reliably passes through the registration sensor 35*b* (352*b*) before the pre-registration sensor arrival timing (332*b*) of the leading edge of the subsequent sheet. With this, an interval of image formation is not only provided with an image interval (303*b*) described with reference to FIG. 3A but also increased by a correction sheet gap for waiting until the preceding sheet has passed through the registration sensor (304*b*). The CPU 211 outputs the /TOP signal of the second sheet (305*b*) after the time period corresponding to (image size (302*b*))+(image interval (303*b*))+(correction sheet gap for waiting until the preceding sheet has passed through the registration sensor (304*b*)) has elapsed since the /TOP signal of the first sheet is output (301*b*). Therefore, in the case of using the same driving source to drive the cassette pickup roller and the registration roller 18, productivity becomes lower than in the case of using the separate driving sources to drive the cassette pickup roller 17 and the registration roller 18.

(Conveyance Speed Control According to this Embodiment)

Figure 4:
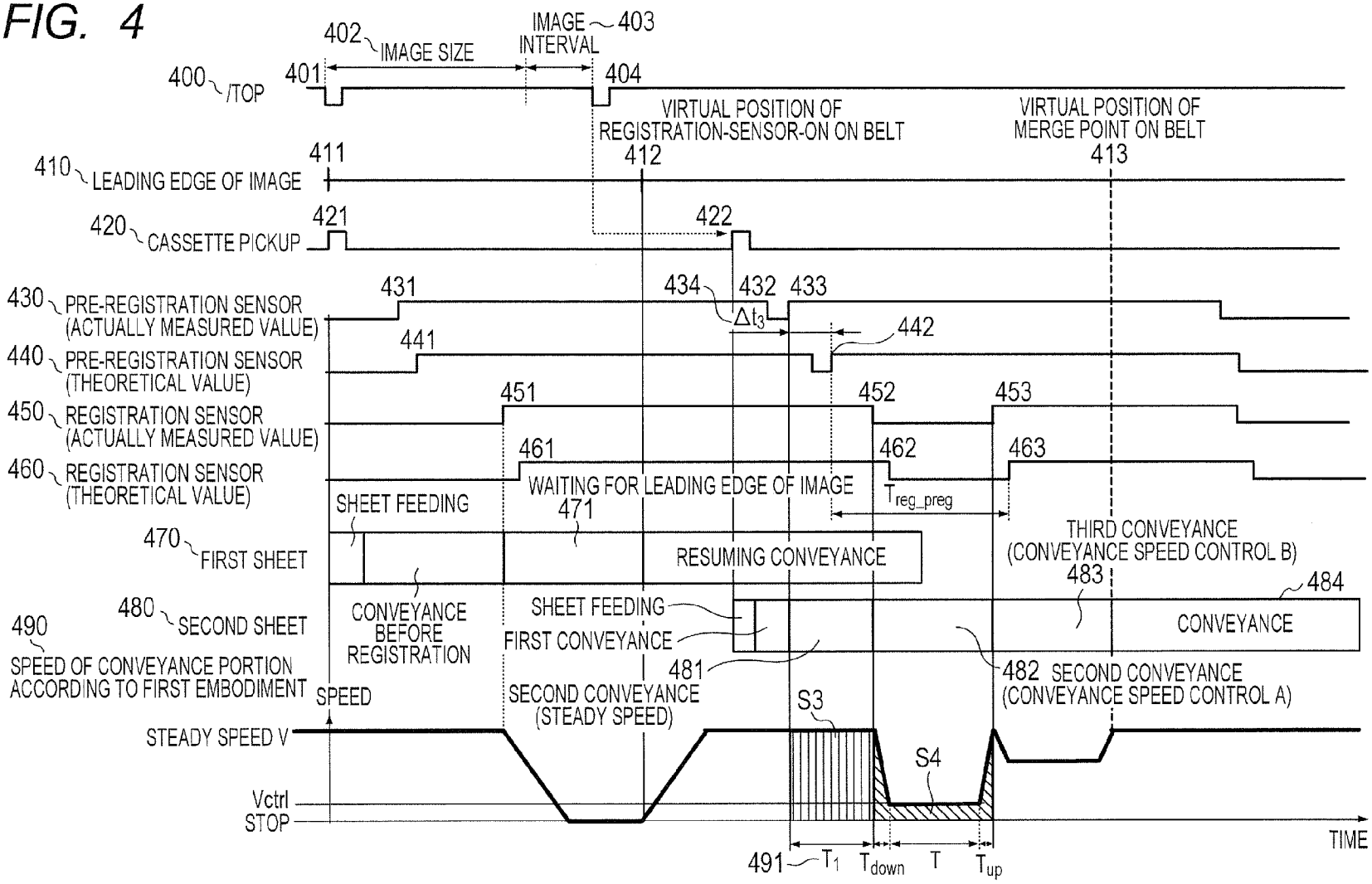
FIG. 4 is a timing chart of conveyance speed control according to the first embodiment.

FIG. 4 is a timing chart of two-sheet continuous printing according to this embodiment. In this embodiment, a method of canceling variations of the sheet feeding and the conveyance of the recording material without increasing an image interval even in a configuration in which conveyance portions between the start of the sheet feeding and the arrival at the secondary transfer position are driven by the same driving source is described. In the timing chart of FIG. 4, the respective signals correspond to those of FIGS. 3A and 3B, and descriptions thereof are omitted. In FIG. 4, the reference symbols on the order of 400 correspond to the reference symbols on the order of 300 used in FIGS. 3A and 3B. However, in FIG. 4, in terms of the pre-registration sensor 35*a*, a timing at which the trailing edge of the first sheet passes therethrough is assumed as the actually measured value 432, the arrival timing of the leading edge of the second sheet is assumed as the actually measured value 433, and a difference time period $\Delta t_3$ described later is assumed as a difference time period 434.

The CPU 211 outputs the /TOP signal of the first sheet (401), and starts the image forming operation for the first sheet (411). Further, the CPU 211 instructs the sheet conveyance portion 215 to start the printing operation, and the conveyance control portion 221 of the sheet conveyance portion 215 starts the sheet feeding operation (421). The conveyance control portion 221 conveys the first sheet until the leading edge of the first sheet arrives at the registration sensor 35*b* (451). At the timing at which the leading edge of the first sheet arrives at the registration sensor 35*b* (451), the conveyance control portion 221 decreases the speed of the conveyance portion from the steady speed V to stop the conveyance control. The conveyance control portion 221 sets the first sheet to a state of "waiting for leading edge of image" (471) until the leading edge of the image arrives at a virtual position of registration-sensor-on 412 on the intermediate transfer belt 80. When the leading edge of the image arrives at the virtual position of registration-sensor-on 412 on the intermediate transfer belt 80, the conveyance control portion 221 resumes the conveyance control for the recording material in synchronization with the image formed on the intermediate transfer belt 80 (412). That is, the speed of the conveyance portion is returned to the steady speed V, and the conveyance of the first sheet is resumed (indicated in the figure as "resuming conveyance" in a status 470 of the first sheet).

The CPU 211 outputs the /TOP signal of the second sheet after a time period corresponding to (image size (402))+(margin between images (image interval (403))) has elapsed since the output timing (401) of the /TOP signal of a first sheet (404). In this point, this embodiment is different from the conventional control of FIG. 3B provided additionally with the correction sheet gap for waiting until the preceding sheet has passed through the registration sensor (304*b*). The CPU 211 instructs the sheet conveyance portion 215 to start the printing operation at the output timing (404) of the /TOP signal of the second sheet, and the conveyance control portion 221 starts the sheet feeding operation for the second sheet at a sheet feeding timing (422) determined from the output timing (404) of the /TOP signal. At the timing (433) at which the leading edge of the second sheet arrives at the pre-registration sensor 35*a*, the conveyance control portion 221 calculates the difference time period $\Delta t_3$ (434) between a theoretical value (442) of the pre-registration sensor arrival timing and the actually measured value (433) thereof instead of carrying out the conveyance speed control A. Then, until the timing (452) at which the trailing edge of the first sheet being the preceding sheet passes through the registration sensor 35*b*, the conveyance control portion 221 conveys the first sheet and the second sheet at the steady speed V (481) (indicated in the figure as "second conveyance (steady speed)" in a status 480 of the second sheet).

The conveyance control portion 221 uses, for example, the timer (not shown) to measure a time period $T_1$ (491) elapsed after the timing (433) at which the leading edge of the second sheet being the subsequent sheet (current sheet) arrives at the pre-registration sensor 35*a* until the timing (452) at which the trailing edge of the first sheet being the preceding sheet passes through the registration sensor 35*b*. Then, the conveyance control portion 221 carries out the conveyance speed control A for the second recording material (482) at the timing (452) at which the trailing edge of the preceding sheet passes through the registration sensor 35*b*.

(Conveyance Speed Control A)

The method of calculating the speed for conveying the recording material by the conveyance speed control A is described below.

Assuming that $T_1$ is the time period (491) taken by the preceding sheet (first sheet) to pass through the registration sensor, a time period for carrying out the conveyance speed control A is expressed as the following expression.

$$T_{reg_preg}+\Delta t_3-T_1=T_{down}+T+T_{up} \quad \text{(Expression 9)}$$

Assuming that:

V is a steady speed;

$V_{ctrl}$ is a conveyance speed controlling speed;

S3 is a recording material conveyance distance from arrival of the leading edge of the subsequent sheet at the pre-registration sensor 35*a* up to passing of the trailing edge of the preceding sheet through the registration sensor 35*b*; and S4 is a recording material conveyance distance of the subsequent sheet that is conveyed by the conveyance speed control A, the following expression is established.

$$S3=V\times T_1$$

$$S4=((V+V_{ctrl})\times T_{down})/2+(T\times V_{ctrl})+((V+V_{ctrl})\times T_{up})/2$$

A sum of the recording material conveyance distance (S3) and the recording material conveyance distance (S4) of the subsequent sheet that is conveyed by the conveyance speed control A is the same as the conveyance distance ($=T_{reg_preg}\times V$) in the case where the leading edge of the recording material arrives at the pre-registration sensor 35*a* and the registration sensor 35*b* at ideal timings. The ideal timing is a timing assumed in the case where the recording material is conveyed at the steady speed V without the conveyance speed control. Accordingly, the following expression is established.

(Expression 10)

$$\begin{aligned} T_{reg_preg}\times V &= S3+S4 \\ &= (V\times T_1)+((V+V_{ctrl})\times T_{down})/2+(T\times V_{ctrl})+ \\ &\quad ((V+V_{ctrl})\times T_{up})/2 \end{aligned}$$

The conveyance speed control A is carried out by calculating $V_{ctrl}$ and T from (Expression 4), (Expression 5), (Expression 9), and (Expression 10). The acceleration g is as described above.

The recording material conveyance distance S1 of the recording material that is conveyed by the conveyance speed control A according to the conventional example is equal to the sum of the recording material conveyance distance S3 of the recording material that is conveyed by the conveyance control from the pre-registration sensor 35*a* until the start of the conveyance speed control and the recording material conveyance distance S4 of the recording material that is conveyed by the conveyance speed control A according to this embodiment. That is, the following expression is established.

$$T_{reg_preg}\times V=S1=S3+S4.$$

The conveyance control portion 221 performs the conveyance speed control B (483) at a timing (453) at which the leading edge of the second recording material arrives at the registration sensor 35*b*.

(Conveyance Speed Control B)

The conveyance speed control B is described below in detail. First, a difference between an actually measured value (453) of the registration sensor arrival timing of the second recording material detected by the registration sensor 35*b* at the timing (453) and a theoretical value (463) thereof defined in advance is calculated. The conveyance control portion 221 carries out the conveyance speed control by increasing or decreasing the conveyance speed so that the conveyance control portion 221 can cancel this difference (conveyance variation) before the arrival time (413) at the merge point 35*c*. The conveyance speed control B is performed so as to return the conveyance speed to the steady speed V immediately before the leading edge of the second recording material arrives at the merge point 35*c*. The conveyance speed is calculated by the same method as the conventional examples described with reference to FIGS. 3A and 3B.

The conveyance control portion 221 conveys the recording material by switching the conveyance speed to the steady speed V through the conveyance speed control B before the leading edge of the second sheet arrives at the merge point 35*c* (413), the CPU 211 causes the fixing control portion 214 to fix the image thereto, and the recording material is delivered to the outside of the apparatus (484).

(Recording Material Conveyance Control Processing According to this Embodiment)

Figure 5:
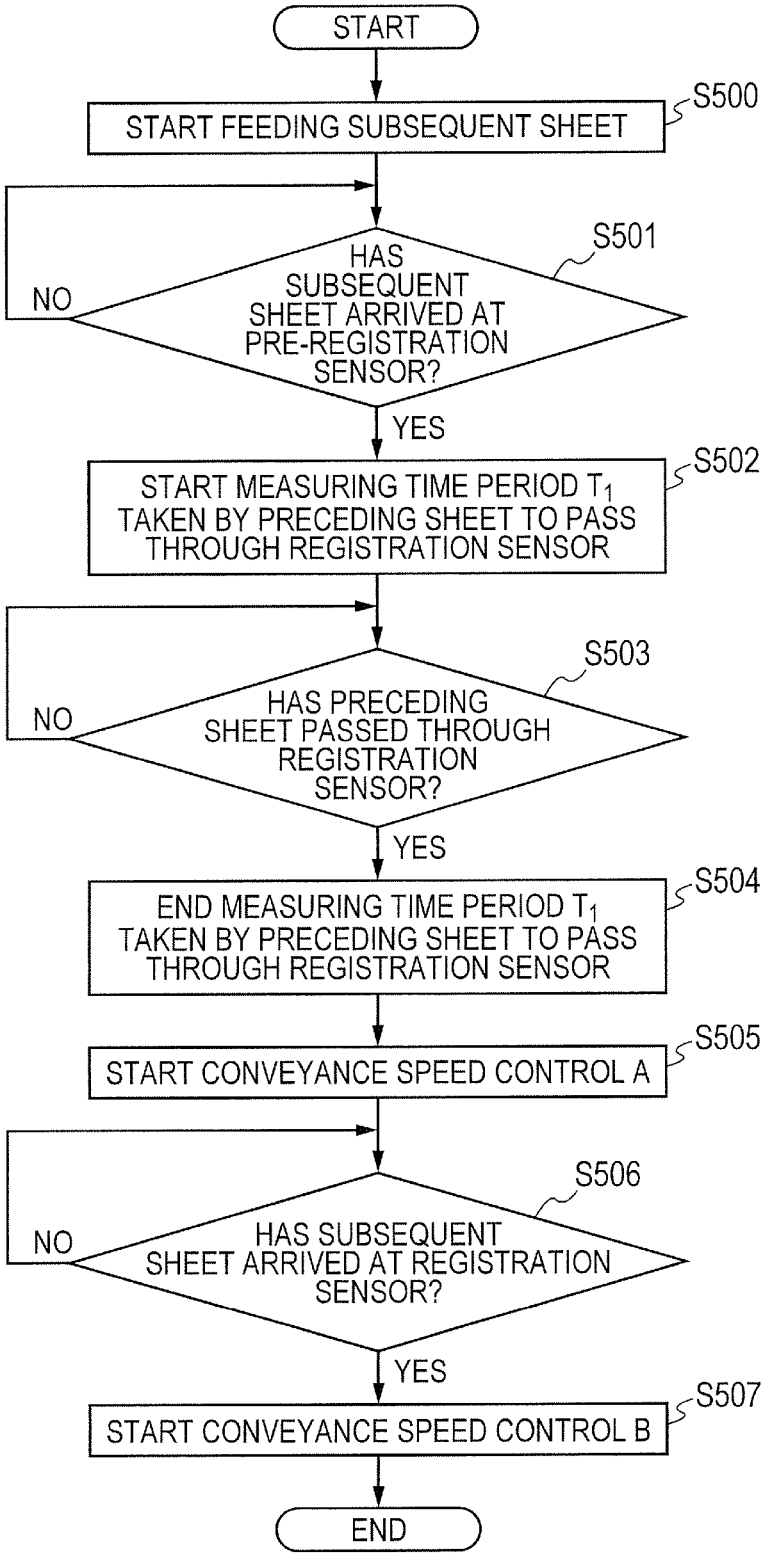
FIG. 5 is a flowchart of the conveyance speed control according to the first embodiment.

FIG. 5 is a flowchart according to this embodiment. The flowchart of FIG. 5 is a flowchart relating to recording material conveyance control for the second sheet (subsequent sheet) to be subjected to the conveyance speed control. The control is described below in detail. In Step S500 (hereinafter referred to simply as "S500"; the same applies to the other step numbers), the conveyance control portion 221 causes the cassette pickup roller 17 to start feeding the second recording material to be subjected to the conveyance speed control at a predetermined timing (timing 422 in FIG. 4) after the CPU 211 outputs the /TOP signal (output timing 404 in FIG. 4). In S501, the conveyance control portion 221 determines whether or not the leading edge of the second sheet has been detected by the pre-registration sensor 35*a*, that is, whether or not the subsequent sheet has arrived at the pre-registration sensor 35*a*. When determining in S501 that the subsequent sheet has not arrived at the pre-registration sensor 35*a*, the conveyance control portion 221 returns to the processing of S501. When determining in S501 that the leading edge of the second sheet being the subsequent sheet has arrived at the pre-registration sensor 35*a* (actually measured value 433 in FIG. 4), the conveyance control portion 221 starts the timer (not shown) in S502, and starts measuring the time period $T_1$ (491) taken by the preceding sheet to pass through the registration sensor (S502).

In S503, the conveyance control portion 221 determines whether or not the trailing edge of the first sheet being the preceding sheet has been detected by the registration sensor 35*b*, that is, whether or not the preceding sheet has passed through the registration sensor 35*b*. When determining in S503 that the preceding sheet has not passed through the registration sensor 35*b*, the conveyance control portion 221 returns to the processing of S503. When determining in S503 that the trailing edge of the first sheet being the preceding sheet has passed through the registration sensor 35*b* (actually measured value 452 in FIG. 4), in S504, the conveyance control portion 221 stops the timer started in S502 to end measuring the time period $T_1$ (491) taken by the preceding sheet to pass through the registration sensor. In S505, the conveyance control portion 221 starts the conveyance speed control A described above. Here, the conveyance control portion 221 carries out the conveyance speed control A (status 482 in FIG. 4) by calculating $V_{ctrl}$ and T from (Expression 4), (Expression 5), (Expression 9), and (Expression 10) as described above.

In S506, the conveyance control portion 221 determines whether or not the leading edge of the second recording material has been detected by the registration sensor 35*b*, that is, whether or not the subsequent sheet has arrived at the registration sensor 35*b*. When determining in S506 that the subsequent sheet has not arrived at the registration sensor 35*b*, the conveyance control portion 221 returns to the processing of S506. When determining in S506 that the leading edge of the subsequent sheet has arrived at the registration sensor 35*b* (actually measured value 453 in FIG. 4), the conveyance control portion 221 carries out the conveyance speed control B in S507 (status 483 in FIG. 4).

According to this embodiment, in the image forming apparatus for conveying the recording material from the start of the sheet feeding up to the arrival at the secondary transfer position by using one driving source, the recording materials are controlled as follows when being conveyed continuously. That is, the conveyance speed of a subsequent recording material is controlled at the timing at which the recording material being conveyed earlier has passed through the conveying path being driven by the driving source. With this control, it is possible to obtain a satisfactory image while suppressing the variation in the sheet feeding or conveyance without affecting the conveyance of the recording material being conveyed earlier or the secondary transfer thereof and without lowering the productivity. Further, in this embodiment, the example in which two sheet detection sensors are used to control the conveyance speed two times by the conveyance speed control A and the conveyance speed control B is described, but various changes can be made thereto based on the gist of the present invention and are not to be excluded from the scope of the present invention.

As described above, according to this embodiment, it is possible to obtain a satisfactory image while suppressing the conveyance variation of the subsequent sheet without affecting the conveyance of the preceding sheet or the image formation thereof and without lowering the productivity even when the recording materials are continuously conveyed by the same driving source.

Second Embodiment

Figure 6:
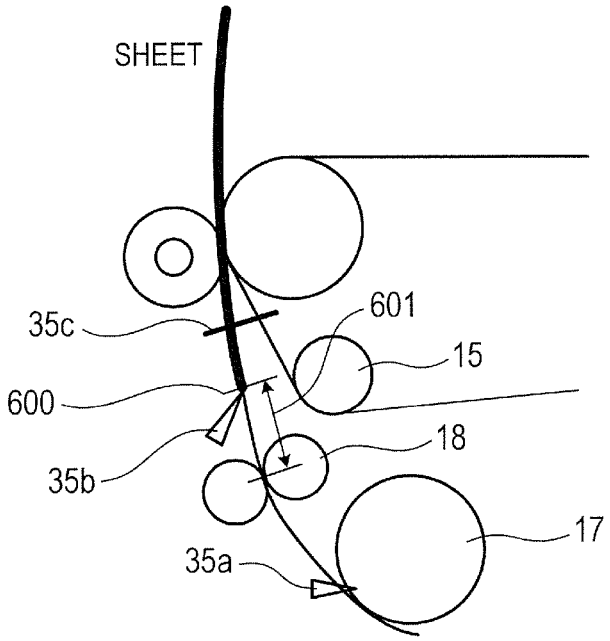
FIG. 6 is a diagram illustrating a structure of a conveyance portion of an image forming apparatus according to a second embodiment of the present invention.

In the first embodiment, the conveyance speed control A is performed after the preceding sheet has passed through the registration roller 18, and hence the conveyance speed control A is carried out after waiting until the trailing edge of the preceding sheet has passed through the registration sensor 35*b*. However, the registration sensor 35*b* detects the trailing edge of the recording material at the timing at which the trailing edge of the recording material arrives at the position downstream of the nip portion of the registration roller 18. FIG. 6 illustrates a main part of the conveying path between a sheet feeding portion and a secondary transfer portion. As illustrated in FIG. 6, at a timing (600) at which the trailing edge of the recording material (thick solid line indicated as "sheet" in the figure) passes through the registration sensor 35*b*, the trailing edge of the recording material has been conveyed downstream of the nip portion of the registration roller 18 by a distance 601.

In the second embodiment, a method of predicting the position of the preceding sheet with the pre-registration sensor 35*a* and carrying out the conveyance speed control A immediately after the trailing edge of the preceding sheet of the recording material has passed through the registration roller 18 is described. An overall structure of the laser printer serving as the image forming apparatus and a system block diagram are the same as those of the first embodiment (FIG. 1 and FIG. 2), and descriptions thereof are omitted.

(Recording Material Conveyance Control According to this Embodiment)

FIG. 7 is a timing chart of two-sheet continuous printing according to this embodiment. In the timing chart of FIG. 7, the image formation and the recording material conveyance control for the first sheet are the same as those of the first embodiment. Therefore, descriptions thereof are omitted, and the recording material conveyance control for the second sheet is described below. In the timing chart of FIG. 7, the respective signals correspond to those of FIG. 4, and the reference symbols on the order of 700 correspond to the reference symbols on the order of 400 used in FIG. 4.

At the timing (732) at which the trailing edge of the preceding sheet has passed through the pre-registration sensor 35*a*, the conveyance control portion 221 starts measuring a time period $T_2$ (792) taken by the preceding sheet to pass through the registration roller for measuring the time period elapsed until the trailing edge of the preceding sheet has passed through the nip portion of the registration roller 18. Here, a distance between the pre-registration sensor 35*a* and the registration roller 18, and the conveyance speed of the recording material are known, and hence it is uniquely determined when the preceding sheet that has passed through the pre-registration sensor 35*a* is to pass through the nip portion of the registration roller 18. That is, from the distance between the pre-registration sensor 35*a* and the registration roller 18 and the conveyance speed (steady speed V) of the preceding sheet, it is possible to calculate the time period $T_2$ (time period taken by the preceding sheet to pass through the registration roller) elapsed after the trailing edge of the preceding sheet passes through the pre-registration sensor 35*a* until the trailing edge of the preceding sheet passes through the registration roller 18. Accordingly, for example, the timer (not shown) may be started when the trailing edge of the preceding sheet passes through the pre-registration sensor 35*a*, and when the time period $T_2$ has elapsed, it is conceivable that the preceding sheet has passed through the nip portion of the registration roller 18. In FIG. 7, the timing of the passing is indicated as a timing 793.

The conveyance control portion 221 measures a time period (pre-registration sensor sheet gap time period) $\Delta t_{blank}$ (791) elapsed after the trailing edge of the first sheet being the preceding sheet has passed through the pre-registration sensor 35*a* (732) until the leading edge of the second sheet being the subsequent sheet (current sheet) that has been fed arrives at the pre-registration sensor 35*a* (733). At the timing (733) at which the leading edge of the subsequent sheet arrives at the pre-registration sensor 35*a*, the conveyance control portion 221 calculates a difference time period $\Delta t_4$ (734) between a theoretical value (742) of the pre-registration sensor arrival timing and an actually measured value (733) thereof, to thereby determine a timing to execute the conveyance speed control A.

The method of calculating the speed for conveying the recording material by the conveyance speed control A is described below.

Assuming that:

$T_2$ is a time period (792) taken by the preceding sheet to pass through the registration roller;

$\Delta t_{blank}$ is a pre-registration sensor sheet gap time period (791); and $\Delta t_4$ is a difference time period (734) between the theoretical value (742) of the pre-registration sensor arrival timing of the second sheet and the actually measured value (733) thereof, the time period for carrying out the conveyance speed control is expressed by the following expression.

$$T_{reg_preg}+\Delta t_4=(T_2-\Delta t_{blank})+T_{down}+T+T_{up} \quad \text{(Expression 11)}$$

Further, assuming that:

V is a steady speed;

$V_{ctrl}$ is a conveyance speed controlling speed;

S5 is a recording material conveyance distance from arrival of the leading edge of the second recording material at the pre-registration sensor 35*a* up to passing of the trailing edge of the preceding sheet through the nip portion of the registration roller 18; and S6 is a recording material conveyance distance of the recording material that is conveyed by the conveyance speed control A, a section (distance) for carrying out the conveyance speed control establishes the following expression.

$$S5=V\times(T_2-\Delta t_{blank})$$

$$S6=((V+V_{ctrl})\times T_{down})/2+(T\times V_{ctrl})+((V+V_{ctrl})\times T_{up})/2$$

A sum of the recording material conveyance distance (S5) and the recording material conveyance distance (S6) of the recording material that is conveyed by the conveyance speed control A is the same as the conveyance distance ($=T_{reg_preg}\times V$) in the case where the leading edge of the recording material arrives at the pre-registration sensor 35*a* and the registration sensor 35*b* at ideal timings. Accordingly, the following expression is established.

(Expression 12)

$$\begin{aligned} T_{reg_preg}\times V &= S5+S6 \\ &= V\times(T_2-\Delta t_{blank})+((V+V_{ctrl})\times T_{down})/2+ \\ &\quad (T\times V_{ctrl})+((V+V_{ctrl})\times T_{up})/2 \end{aligned}$$

In the manner described above, the conveyance speed control A is carried out (782) by calculating $V_{ctrl}$ and T from (Expression 4), (Expression 5), (Expression 11), and (Expression 12).

The conveyance control portion 221 performs the conveyance speed control B (783) at the timing (753) at which the leading edge of the second sheet arrives at the registration sensor 35*b*. In the conveyance speed control B, in the same manner as in the first embodiment, the conveyance speed is calculated by the same method as the conventional examples described with reference to FIGS. 3A and 3B. The conveyance control portion 221 conveys the recording material by switching the conveyance speed to the steady speed through the conveyance speed control B before the sheet leading edge arrives at the merge point 35*c* (713), the CPU 211 causes the fixing control portion 214 to fix the image thereto, and the recording material is delivered to the outside of the apparatus (784).

(Recording Material Conveyance Control Processing According to this Embodiment)

Figure 8:
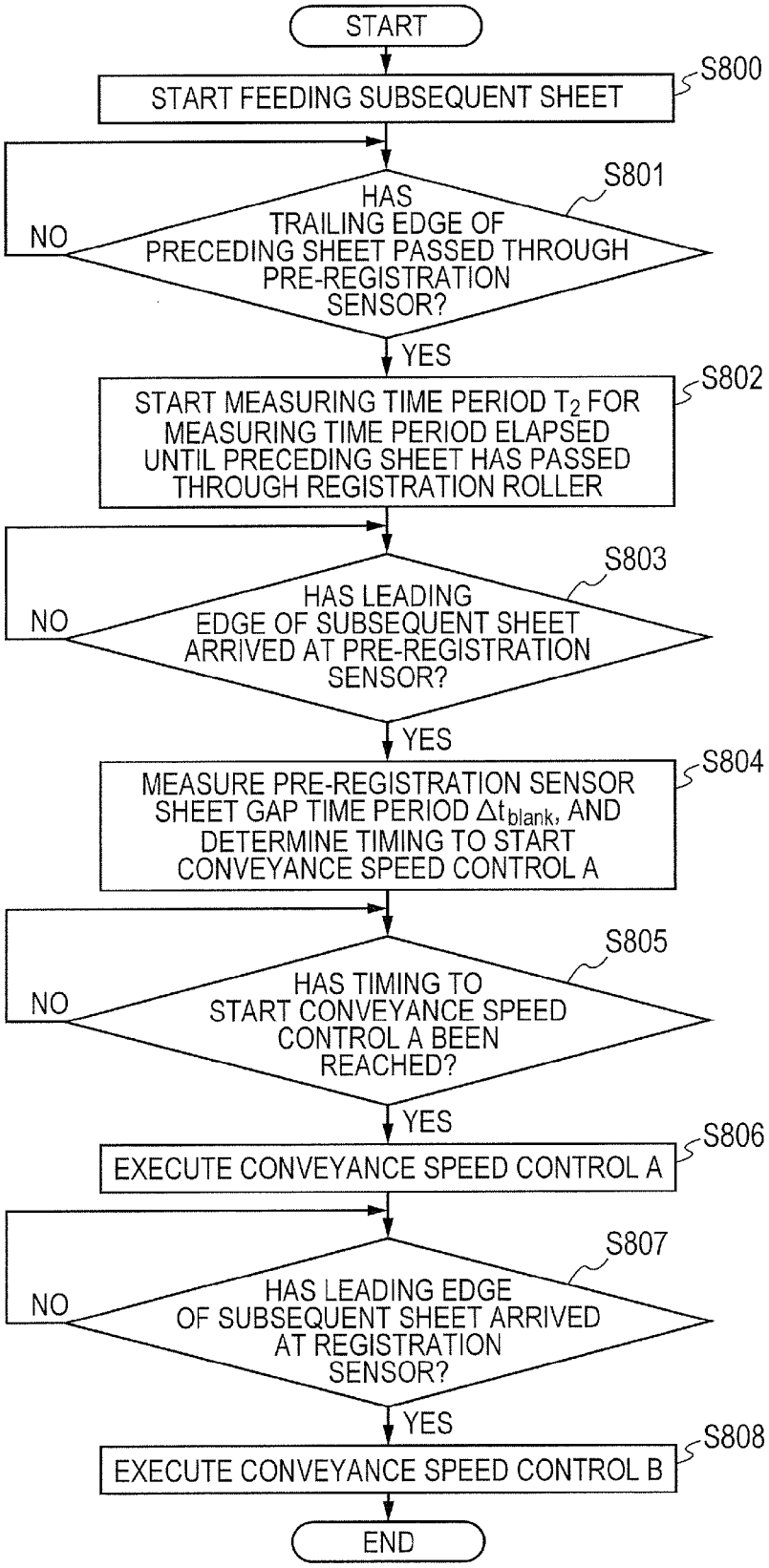
FIG. 8 is a flowchart of the conveyance speed control according to the second embodiment.

FIG. 8 is a flowchart according to this embodiment. The flowchart of FIG. 8 is a flowchart relating to recording material conveyance control for the second sheet (subsequent sheet) to be subjected to the conveyance speed control. The control is described below in detail.

In S800, the conveyance control portion 221 starts feeding the second recording material being the subsequent sheet to be subjected to the conveyance speed control (timing 722 in FIG. 7). In S801, the conveyance control portion 221 determines whether or not the trailing edge of the first sheet being the preceding sheet has passed through the pre-registration sensor 35*a*. When determining in S801 that the trailing edge of the preceding sheet has not passed through the pre-registration sensor 35*a*, the conveyance control portion 221 returns to the processing of S801. When determining in S801 that the trailing edge of the preceding sheet has passed through the pre-registration sensor 35*a* (actually measured value 732 in FIG. 7), the conveyance control portion 221 advances to the processing of S802. In S802, the conveyance control portion 221 starts the timer (not shown) to start measuring the time period $T_2$ for measuring the time period elapsed until the trailing edge of the preceding sheet has passed through the nip portion of the registration roller 18 (timing 793 in FIG. 7).

In S803, the conveyance control portion 221 determines whether or not the leading edge of the second recording material being the subsequent sheet (current sheet) has been detected by the pre-registration sensor 35*a*, that is, whether or not the leading edge of the subsequent sheet has arrived at the pre-registration sensor 35*a*. When determining in S803 that the leading edge of the subsequent sheet has not arrived at the pre-registration sensor 35*a*, the conveyance control portion 221 returns to the processing of S803. When determining in S803 that the leading edge of the subsequent sheet has arrived at the pre-registration sensor 35*a* (actually measured value 733 in FIG. 7), the conveyance control portion 221 advances to the processing of S804. In S804, the conveyance control portion 221 measures the pre-registration sensor sheet gap time period $\Delta t_{blank}$. Further, the conveyance control portion 221 determines the time period $T_2$ elapsed until the preceding sheet has passed through the registration roller as the timing to start the conveyance speed control A as described above. The pre-registration sensor sheet gap time period $\Delta t_{blank}$ may be measured by referring to the value of the timer started in S802, or measured by using a timer other than the timer started in S802.

In S805, the conveyance control portion 221 determines whether or not the timing to start the conveyance speed control A has been reached. When determining in S805 that the timing to start the conveyance speed control A has not been reached, the conveyance control portion 221 returns to the processing of S805. When determining in S805 that the timing to start the conveyance speed control A has been reached (timing 793 in FIG. 7), the conveyance control portion 221 executes the conveyance speed control A in S806 (status 782 in FIG. 7). When determining that the time period $T_2$ of "(distance between pre-registration sensor 35*a* and registration roller 18)/(steady speed V)" has elapsed by referring to the timer that has started measurement in S802, the conveyance control portion 221 determines that the timing to start the conveyance speed control A has been reached. That is, the timing to start the conveyance speed control A is the timing 793 in FIG. 7, which is a timing at which the trailing edge of the preceding sheet is expected to have passed through the registration roller 18. Further, the conveyance control portion 221 carries out the conveyance speed control A by calculating $V_{ctrl}$ and T from (Expression 4), (Expression 5), (Expression 11), and (Expression 12) as described above.

In S807, the conveyance control portion 221 determines whether or not the leading edge of the second sheet being the subsequent sheet (current sheet) has arrived at the registration sensor 35*b*, and when determining that the leading edge of the subsequent sheet has not arrived at the registration sensor 35*b*, returns to the processing of S807. When determining in S807 that the leading edge of the subsequent sheet has arrived at the registration sensor 35*b* (actually measured value 753 in FIG. 7), the conveyance control portion 221 executes the conveyance speed control B in S808 (status 783 in FIG. 7).

According to this embodiment, in the image forming apparatus for conveying the recording material from the start of the sheet feeding up to the arrival at the secondary transfer position by using one driving source, the conveyance speed control for the subsequent recording material is performed as follows when the recording materials are conveyed continuously. That is, the control is performed at the timing at which it is detected that the recording material being conveyed earlier has passed through the position on the conveying path provided with the rollers and the like that are being driven by one driving source. With this control, it is possible to obtain a satisfactory image while suppressing the variation in the sheet feeding or conveyance without affecting the conveyance of the recording material being conveyed earlier or the secondary transfer thereof and without lowering the productivity. Further, unlike the first embodiment, the timing at which the preceding sheet passes through the registration roller 18 is predicted to carry out the conveyance speed control A. Accordingly, it is possible to secure more sections that enable correction by the distance (601) between the registration roller 18 and the registration sensor 35*b*, and correct more variations in the sheet feeding.

In this embodiment, the example in which two recording material detection sensors are used to control the conveyance speed two times by the conveyance speed control A and the conveyance speed control B is described, but various changes can be made thereto based on the gist of the present invention and are not to be excluded from the scope of the present invention.

As described above, according to this embodiment, it is possible to obtain a satisfactory image while suppressing the conveyance variation of the subsequent sheet without affecting the conveyance of the preceding sheet or the image formation thereof and without lowering the productivity even when the recording materials are continuously conveyed by the same driving source.

Third Embodiment

In a third embodiment of the present invention, which has a structure in which a distance between the position of the pre-registration sensor 35*a* and the position of the registration sensor 35*b* is shorter than the image interval of the continuous printing, a method of carrying out the conveyance speed control on an acceleration side from the pre-registration sensor 35*a* and carrying out the conveyance speed control on a deceleration side from the registration sensor 35*b* is described. According to this embodiment, the conveyance speed control on the acceleration side is carried out from the pre-registration sensor 35*a*, and hence it is possible to secure more sections that enable correction of the acceleration. On the other hand, the conveyance speed control on the deceleration side is carried out from the registration sensor 35*b*, and hence it is possible to reduce the conveyance variation between the pre-registration sensor 35*a* and the registration sensor 35*b*. An overall structure of the laser printer serving as the image forming apparatus and a system block diagram are the same as those of the first and second embodiments (FIG. 1 and FIG. 2), and descriptions thereof are omitted.

(Recording Material Conveyance Control According to this Embodiment)

Figure 9:
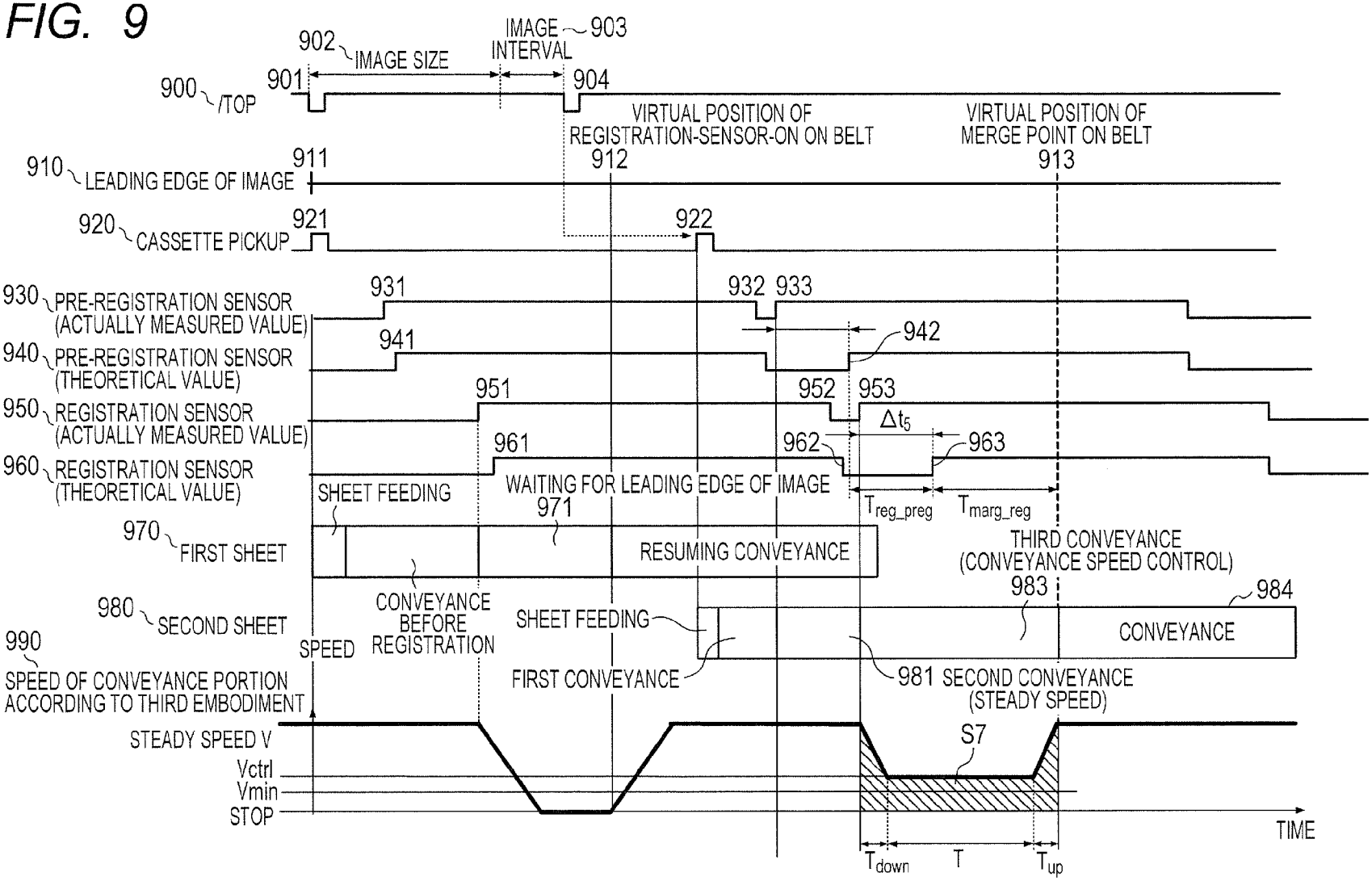
FIG. 9 is a timing chart of conveyance speed control (deceleration processing) according to a third embodiment of the present invention.

FIGS. 9 and 10 are timing charts of two-sheet continuous printing according to this embodiment. In the timing charts of FIGS. 9 and 10, the image formation and the recording material conveyance control for the first sheet (preceding sheet) are the same as those of the first and second embodiments. Therefore, descriptions thereof are omitted, and the recording material conveyance control for the second sheet (subsequent sheet or current sheet) is described below. In the timing charts of FIGS. 9 and 10, the respective signals correspond to those of FIG. 4, and the reference symbols on the order of 900 and 1000 correspond to the reference symbols on the order of 400 used in FIG. 4.

(Conveyance Speed Control on Deceleration Side)

In FIG. 9, when the timing (933) at which the leading edge of the subsequent sheet arrives at the pre-registration sensor 35*a* is earlier than a theoretical value (942) (predetermined timing) of the pre-registration sensor arrival timing, the conveyance control portion 221 determines as follows. That is, the conveyance control portion 221 determines that the conveyance variation can be sufficiently canceled by carrying out the conveyance speed control from the timing (953) at which the leading edge of the subsequent sheet arrives at the registration sensor 35*b*. The timing at which the conveyance control portion 221 starts the conveyance speed control is the timing (953) at which the leading edge of the subsequent sheet arrives at the registration sensor 35*b*, and is therefore after the trailing edge of the preceding sheet has passed through the registration sensor 35*b*.

Subsequently, the conveyance control portion 221 calculates a difference time period $\Delta t_5$ between a theoretical value (963) of the registration sensor arrival timing and an actually measured value (953) thereof at the timing (953) at which the leading edge of the subsequent sheet arrives at the registration sensor 35*b*. The conveyance control portion 221 carries out the conveyance speed control (983) so that this difference time period $\Delta t_5$ can be canceled before the arrival at the merge point 35*c* (913).

The method of calculating the speed for conveying the recording material by the conveyance speed control is described below.

Assuming that:

$T_{marg_reg}$ is a time period between the registration sensor 35*b* and the merge point; and $\Delta t_5$ is a difference time period between the theoretical value (963) of the registration sensor arrival timing and the actually measured value (953) thereof, the time period for carrying out the conveyance speed control is expressed by the following expression.

$$T_{marg_reg}+\Delta t_5=T_{down}+T+T_{up} \quad \text{(Expression 13)}$$

Further, assuming that:

V is a steady speed;

$V_{ctrl}$ is a conveyance speed controlling speed; and

S7 is a recording material conveyance distance of the recording material that is conveyed by the conveyance speed control, a section (distance) for carrying out the conveyance speed control establishes the following expression.

$$S7=((V+V_{ctrl})\times T_{down})/2+(T\times V_{ctrl})+((V+V_{ctrl})\times T_{up})/2$$

The recording material conveyance distance (S7) of the recording material that is conveyed by the conveyance speed control is the same as the conveyance distance ($=T_{marg_reg}\times V$) in the case where the leading edge of the recording material arrives at the registration sensor 35*b* and the merge point 913 at ideal timings, and hence the following expression is established.

$$T_{marg_reg}\lambda V=((V+V_{ctrl})\times T_{down})/2+(T\times V_{ctrl})+((V+V_{ctrl})\times T_{up})/2 \quad \text{(Expression 14)}$$

In the manner described above, the conveyance speed control is carried out by calculating $V_{ctrl}$ and T from (Expression 4), (Expression 5), (Expression 13), and (Expression 14).

The conveyance control portion 221 conveys the recording material by switching the conveyance speed to the steady speed V through the conveyance speed control before the leading edge of the subsequent sheet arrives at the merge point 35*c* (913), the CPU 211 causes the fixing control portion 214 to fix the image thereto, and the recording material is delivered to the outside of the apparatus (984).

(Conveyance Speed Control on Acceleration Side)

Next, FIG. 10 is described. In FIG. 10, when the timing (1033) at which the leading edge of the subsequent sheet arrives at the pre-registration sensor 35*a* is later than a theoretical value (1042) (predetermined timing) of the pre-registration sensor arrival timing, the conveyance control portion 221 determines as follows. That is, the conveyance control portion 221 determines that the conveyance speed control is to be carried out from the timing (1033) at which the leading edge of the second sheet arrives at the pre-registration sensor 35*a*. In this case, the distance between the pre-registration sensor 35*a* and the registration sensor 35*b* is shorter than an image interval (1003), and the first conveyance (1081) of the subsequent sheet is late. Therefore, it may be conceivable that the trailing edge of the preceding sheet has already passed through the registration sensor 35*b* (1052) at the timing at which the conveyance control portion 221 starts the conveyance speed control.

The conveyance control portion 221 calculates a difference time period $\Delta t_6$ between the theoretical value (1042) of the pre-registration sensor arrival timing and an actually measured value (1033) thereof, and the conveyance speed control is carried out so that this difference time period $\Delta t_6$ can be canceled before the arrival at the merge point 35*c* (1013).

Assuming that $\Delta t_6$ is a difference time period between the theoretical value (1042) of the pre-registration sensor arrival timing and the actually measured value (1033) thereof, the time period for carrying out the conveyance speed control is expressed as the following expression.

$$T_{marg_reg}+T_{reg_preg}-\Delta t_6=T_{up}+T+T_{down} \quad \text{(Expression 15)}$$

Further, assuming that:

V is a steady speed;

$V_{ctrl}$ is a conveyance speed controlling speed; and

S8 is a recording material conveyance distance of the recording material that is conveyed by the conveyance speed control, a section (distance) for carrying out the conveyance speed control establishes the following expression.

$$S8=((V+V_{ctrl})\times T_{up})/2+(T\times V_{ctrl})+((V+V_{ctrl})\times T_{down})/2$$

The recording material conveyance distance (S8) of the recording material that is conveyed by the conveyance speed control is the same as the conveyance distance ($=(T_{marg_reg}+T_{reg_preg})\times V$) in the case where the leading edge of the recording material arrives at the pre-registration sensor 35*a*, the registration sensor 35*b*, and the merge point 1013 at ideal timings, and hence the following expression is established.

$$(T_{marg_reg}+T_{reg_preg})\times V=((V+V_{ctrl})\times T_{up})/2+(T\times V_{ctrl})+((V+V_{ctrl})\times T_{down})/2 \quad \text{(Expression 16)}$$

In the manner described above, the conveyance speed control is carried out by calculating $V_{ctrl}$ and T from (Expression 4), (Expression 5), (Expression 15), and (Expression 16).

The conveyance control portion 221 conveys the recording material by switching the conveyance speed to the steady speed through the conveyance speed control before the leading edge of the subsequent sheet arrives at the merge point 35*c* (1013), the CPU 211 causes the fixing control portion 214 to fix the image thereto, and the recording material is delivered to the outside of the apparatus (1084).

(Recording Material Conveyance Control Processing According to this Embodiment)

Figure 11:
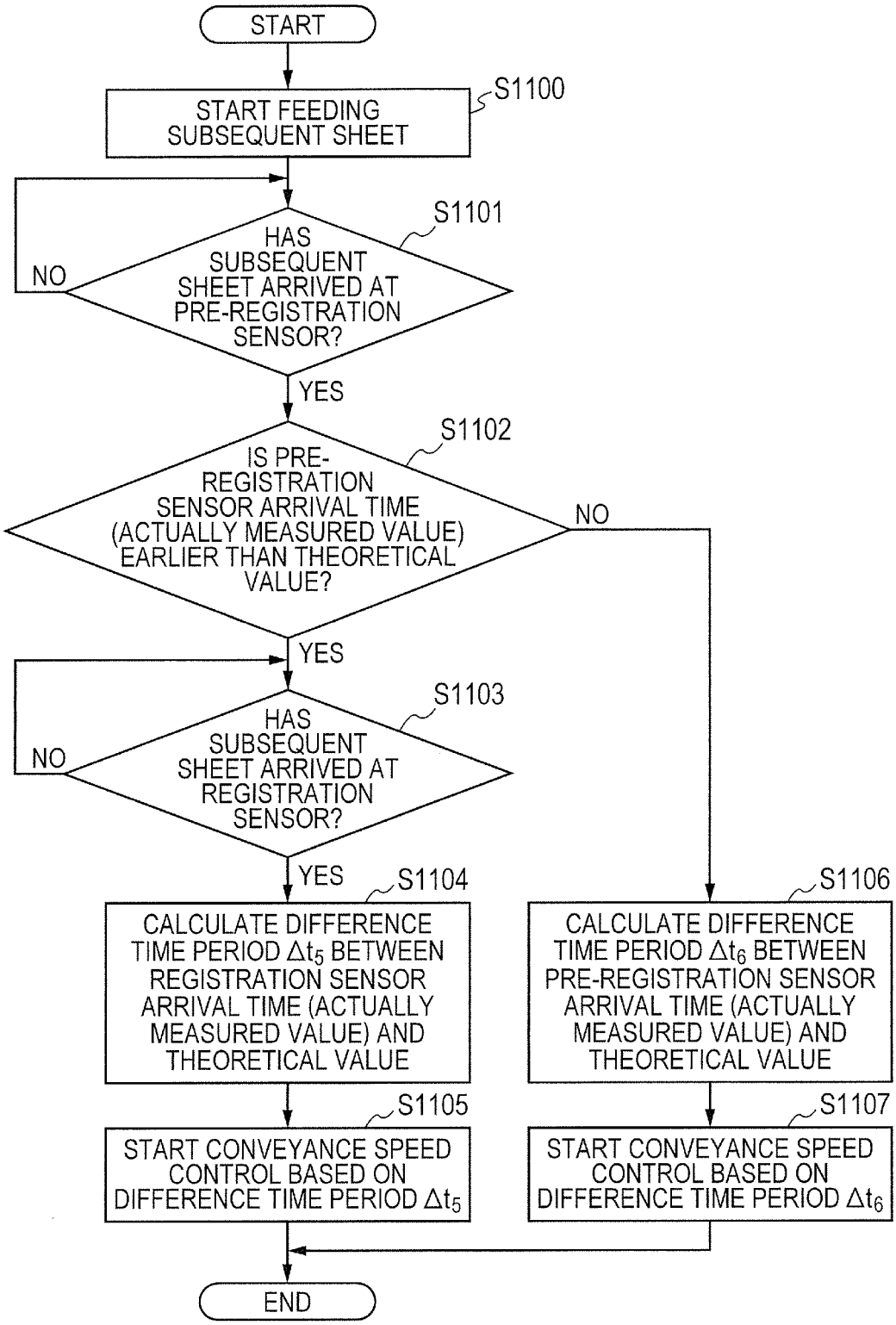
FIG. 11 is a flowchart of the conveyance speed control according to the third embodiment.

FIG. 11 is a flowchart according to this embodiment. The flowchart of FIG. 11 is a flowchart relating to recording material conveyance control for the second sheet (subsequent sheet or current sheet) to be subjected to the conveyance speed control. The control is described below in detail.

In S1100, the conveyance control portion 221 starts feeding the second recording material to be subjected to the conveyance speed control (timing 922 in FIG. 9 and timing 1022 in FIG. 10). In S1101, the conveyance control portion 221 determines whether or not the leading edge of the subsequent sheet has been detected by the pre-registration sensor 35*a*, that is, whether or not the subsequent sheet has arrived at the pre-registration sensor 35*a*. When determining in S1101 that the subsequent sheet has not arrived at the pre-registration sensor 35*a*, the conveyance control portion 221 returns to the processing of S1101. When determining in S1101 that the leading edge of the subsequent sheet has arrived at the pre-registration sensor 35*a* (actually measured value 933 in FIG. 9 and actually measured value 1033 in FIG. 10), the conveyance control portion 221 determines in S1102 whether or not the actually measured value of a pre-registration sensor arrival time of the subsequent sheet is earlier than the theoretical value thereof.

When determining in S1102 that the actually measured value of the pre-registration sensor arrival time of the subsequent sheet is earlier than the theoretical value thereof (actually measured value 933 in FIG. 9), the conveyance control portion 221 carries out the conveyance speed control on the deceleration side at the timing at which the leading edge of the second sheet arrives at the registration sensor 35*b* (actually measured value 953 in FIG. 9). In S1103, the conveyance control portion 221 determines whether or not the leading edge of the subsequent sheet has been detected by the registration sensor 35*b*, that is, whether or not the subsequent sheet has arrived at the registration sensor 35*b*. When determining in S1103 that the subsequent sheet has not arrived at the registration sensor 35*b*, the conveyance control portion 221 returns to the processing of S1103. When determining in S1103 that the subsequent sheet has arrived at the registration sensor 35*b* (actually measured value 953 in FIG. 9), the conveyance control portion 221 advances to the processing of S1104. In S1104, the conveyance control portion 221 calculates the difference time period $\Delta t_5$ between the actually measured value of a registration sensor arrival time and the theoretical value thereof, and in S1105, starts the conveyance speed control based on the difference time period $\Delta t_5$ (status 983 of "third conveyance" in FIG. 9). That is, the conveyance control portion 221 carries out the conveyance speed control on the deceleration side by calculating $V_{ctrl}$ and T from (Expression 4), (Expression 5), (Expression 13), and (Expression 14) as described above.

When determining in S1102 that the actually measured value of the pre-registration sensor arrival time of the subsequent sheet is later than the theoretical value thereof (actually measured value 1033 in FIG. 10), the conveyance control portion 221 advances to the processing of S1106. In S1106, the conveyance control portion 221 calculates the difference time period $\Delta t_6$ between the actually measured value of the pre-registration sensor arrival time and the theoretical value thereof, and in S1107, starts the conveyance speed control based on the difference time period $\Delta t_6$ (status 1083 of "second conveyance/third conveyance" in FIG. 10). The conveyance control portion 221 carries out the conveyance speed control on the acceleration side by calculating $V_{ctrl}$ and T from (Expression 4), (Expression 5), (Expression 15), and (Expression 16) as described above.

According to this embodiment, in the image forming apparatus for conveying the recording material from the start of the sheet feeding up to the arrival at the secondary transfer position by using one driving source in which two recording material detection sensors are arranged in such positions that a distance therebetween is shorter than the image interval of the continuous printing, the following effect is produced. That is, the conveyance speed control on the acceleration side is carried out from the sensor on the upstream side (pre-registration sensor 35*a*), and the conveyance speed control on the deceleration side is carried out from the sensor on the downstream side (registration sensor 35*b*). Accordingly, it is possible to secure more sections that enable correction of the acceleration and reduce the conveyance variation up to the sensor on the downstream side (registration sensor).

In this embodiment, the two recording material detection sensors are described by using the pre-registration sensor as the sensor on the upstream side on the conveying path and the registration sensor as the sensor on the downstream side, but various changes can be made thereto based on the gist of the present invention and are not to be excluded from the scope of the present invention.

As described above, according to this embodiment, it is possible to obtain a satisfactory image while suppressing the conveyance variation of the subsequent sheet without affecting the conveyance of the preceding sheet or the image formation thereof and without lowering the productivity even when the recording materials are continuously conveyed by the same driving source.

Fourth Embodiment

In the third embodiment, the method of carrying out the conveyance speed control on the acceleration side from the pre-registration sensor and carrying out the conveyance speed control on the deceleration side from the registration sensor is described. In a fourth embodiment of the present invention, a method of performing determination in the following manner depending on whether or not a conveyance variation amount detected by the pre-registration sensor 35*a* is larger than a variation correction amount (predetermined amount) that can be corrected between the registration sensor 35*b* and the merge point 35*c* is described. That is, a method of determining whether the conveyance speed control is carried out from the pre-registration sensor 35*a* or from the registration sensor 35*b* based on the conveyance variation amount detected by the pre-registration sensor 35*a* is described. In this case, even in the case where the conveyance speed control on the acceleration side according to the third embodiment is carried out from the pre-registration sensor 35*a*, the conveyance speed control on the acceleration side can be carried out from the registration sensor 35*b* depending on the conveyance variation amount.

When the conveyance variation amount detected by the pre-registration sensor 35*a* is smaller than the variation correction amount that can be corrected between the registration sensor 35*b* and the merge point, the conveyance speed control is carried out from the registration sensor 35*b*. With this control, in an image forming apparatus having such a hardware configuration that a variation occurs even between the pre-registration sensor 35*a* and the registration sensor 35*b*, it is possible to reduce the conveyance variation between the pre-registration sensor 35*a* and the registration sensor 35*b* to a lower level than in the third embodiment. An overall structure of the laser printer serving as the image forming apparatus and a system block diagram are the same as those of the first, second, and third embodiments (FIG. 1 and FIG. 2), and descriptions thereof are omitted.

(Recording Material Conveyance Control According to this Embodiment)

FIG. 12 is a timing chart of two-sheet continuous printing according to this embodiment. In the timing chart of FIG. 12, the image formation and the recording material conveyance control for the first sheet (preceding sheet) are the same as those of the first and second embodiments. Therefore, descriptions thereof are omitted, and the recording material conveyance control for the second sheet (subsequent sheet or current sheet) is described below. Note that, in the timing chart of FIG. 12, the respective signals correspond to those of FIG. 4, and the reference symbols on the order of 1200 correspond to the reference symbols on the order of 400 used in FIG. 4.

In FIG. 12, the conveyance control portion 221 calculates a difference time period $\Delta t_7$ between a theoretical value (1242) of the pre-registration sensor arrival timing and an actually measured value (1233) thereof at the timing (1233) at which the leading edge of the second sheet being the subsequent sheet arrives at the pre-registration sensor 35*a*. Then, the conveyance control portion 221 determines whether or not the conveyance variation can be sufficiently canceled by carrying out the conveyance speed control from the timing (1253) at which the leading edge of the subsequent sheet arrives at the registration sensor 35*b*.

Now, the method of determining whether or not the conveyance variation can be sufficiently canceled by carrying out the conveyance speed control from the registration sensor 35*b* is described. Supposing that there is no conveyance variation between the pre-registration sensor 35*a* and the registration sensor 35*b*, the same difference time period $\Delta t_7$ is used as a difference time period between a theoretical value (1263) of the arrival timing of the subsequent sheet at the registration sensor 35*b* and the actually measured value (1253) thereof.

Assuming that:

$\Delta t_7$ is a difference time period between the theoretical value (1242, 1263) and the actually measured value (1233, 1253) of the arrival timing of the pre-registration sensor 35*a* or the registration sensor 35*b*;

S9 is a distance corresponding to the conveyance variation amount at the registration sensor 35*b* (hereinafter referred to simply as "conveyance variation amount");

S10 is a recording material conveyance distance that can be corrected by the conveyance speed control on the acceleration side at a maximum speed $V_{max}$ of the motor from the registration sensor 35*b* (variation correction amount);

V is a steady speed; and $V_{max}$ is a maximum speed, the following expression is established.

$$S9=V\times\Delta t_7 \quad \text{(Expression 17)}$$

$$S10=((V+V_{max})\times T_{up})/2+(T\times V_{max})+((V+V_{max})\times T_{down})/2 \quad \text{(Expression 18)}$$

It suffices that the recording material conveyance distance that can be corrected by the conveyance speed control on the acceleration side at the maximum speed $V_{max}$ of the motor from the registration sensor 35*b* (variation correction amount) (S10) is larger than the conveyance variation amount (S9) at the registration sensor 35*b* (S9<S10), and hence the following expression is established.

$$V\times\Delta t_7<((V+V_{max})\times T_{up})/2+(T\times V_{max})+((V+V_{max})\times T_{down})/2 \quad \text{(Expression 19)}$$

As described above, when the values satisfying (Expression 19) are obtained by (Expression 4), (Expression 5), and $\Delta t_7$, the conveyance control portion 221 determines that the conveyance variation can be sufficiently canceled by carrying out the conveyance speed control from the registration sensor 35*b*.

Supposing that there is no conveyance variation between the pre-registration sensor 35*a* and the registration sensor 35*b*, the description is made as follows. That is, the same difference time period $\Delta t_7$ is used to describe the difference between the theoretical value (1242) of the arrival timing at the pre-registration sensor 35*a* and the actually measured value (1233) thereof and the difference between the theoretical value (1263) of the arrival timing at the registration sensor 35*b* and the actually measured value (1253) thereof. When there is a conveyance variation between the pre-registration sensor 35*a* and the registration sensor 35*b*, from data on the conveyance variation, the left-hand side of (Expression 19) may be set as (Expression 20) by substituting (Expression 17) with the following expression.

$$S9=V\times(\Delta t_7+\Delta t_{margin}) \quad \text{(Expression 20)}$$

Presence/absence of the conveyance variation between the pre-registration sensor 35*a* and the registration sensor 35*b* and the conveyance variation amount are different between individual image forming apparatus, and can be obtained in advance by experiment. When there is a conveyance variation, the data on the conveyance variation may be measured by experiment, and the maximum value of the measured value, a value obtained by adding a margin to the maximum value, or the like may be set as $\Delta t_{margin}$ and stored in the memory (not shown) or the like.

(Recording Material Conveyance Control Processing According to this Embodiment)

Figure 13:
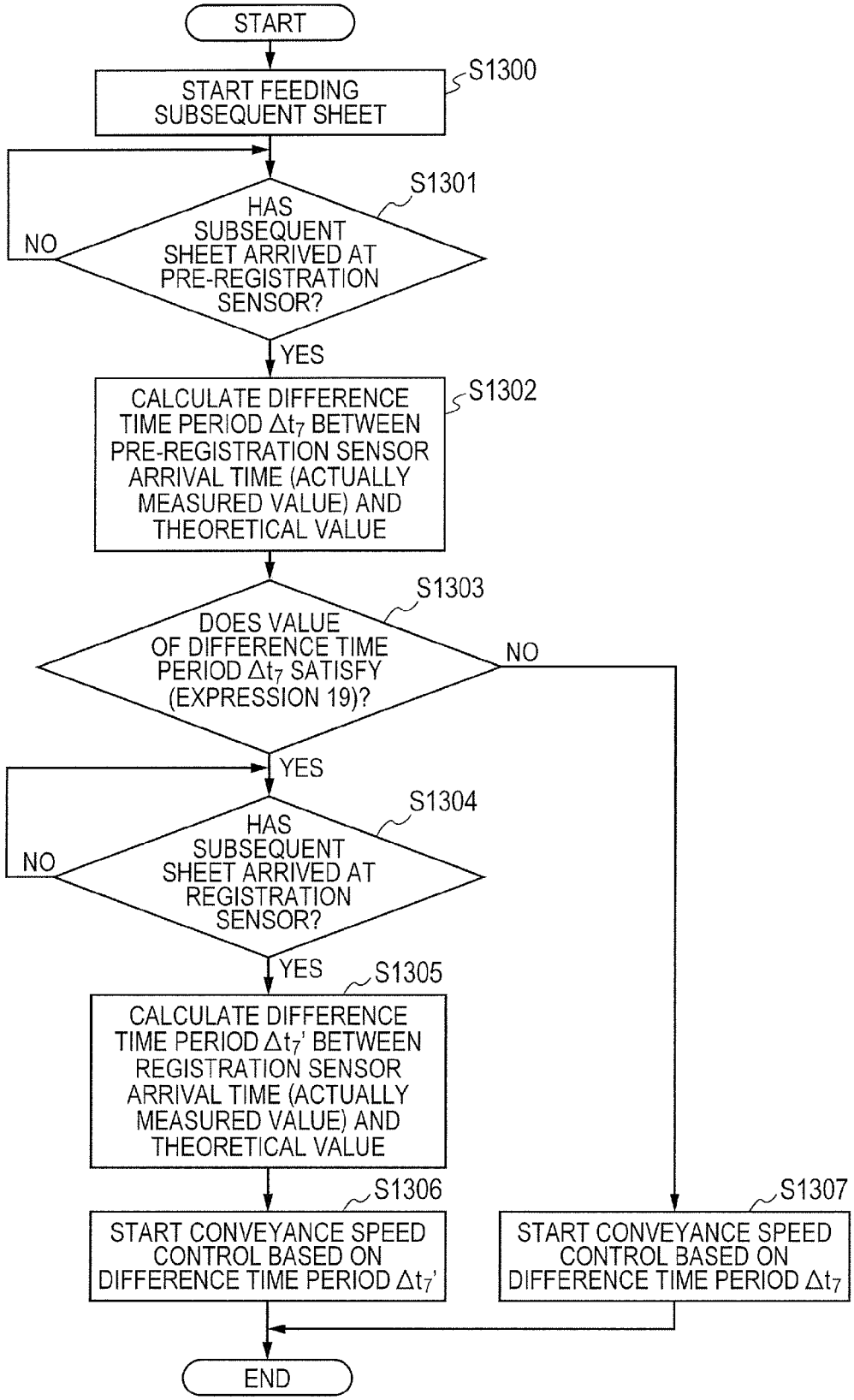
FIG. 13 is a flowchart of the conveyance speed control according to the fourth embodiment.

FIG. 13 is a flowchart according to this embodiment. The flowchart of FIG. 13 is a flowchart relating to recording material conveyance control for the second sheet (subsequent sheet or current sheet) to be subjected to the conveyance speed control. The control is described below in detail.

In S1300, the conveyance control portion 221 starts feeding the second recording material being the subsequent sheet to be subjected to the conveyance speed control (timing 1222 in FIG. 12). In S1301, the conveyance control portion 221 determines whether or not the leading edge of the subsequent sheet has been detected by the pre-registration sensor 35*a*, that is, whether or not the subsequent sheet has arrived at the pre-registration sensor 35*a*. When determining in S1301 that the subsequent sheet has not arrived at the pre-registration sensor 35*a*, the conveyance control portion 221 returns to the processing of S1301. When determining in S1301 that the subsequent sheet has arrived at the pre-registration sensor 35*a* (actually measured value 1233 in FIG. 12), the conveyance control portion 221 advances to the processing of S1302. In S1302, the conveyance control portion 221 calculates the difference time period $\Delta t_7$ between the actually measured value (actually measured value 1233 in FIG. 12) of the pre-registration sensor arrival time and the theoretical value (theoretical value 1242 in FIG. 12) thereof, and determines in S1303 whether or not a value of the difference time period $\Delta t_7$ satisfies (Expression 19). Here, in the case of the image forming apparatus in which there is no conveyance variation between the pre-registration sensor 35*a* and the registration sensor 35*b*, the conveyance control portion 221 sets the left-hand side of (Expression 19) as (Expression 17). Further, in the case of the image forming apparatus in which there is a conveyance variation between the pre-registration sensor 35*a* and the registration sensor 35*b*, the conveyance control portion 221 sets the left-hand side of (Expression 19) as (Expression 20).

When determining in S1303 that the value of the difference time period $\Delta t_7$ satisfies (Expression 19), the conveyance control portion 221 determines in S1304 whether or not the leading edge of the subsequent sheet has been detected by the registration sensor 35*b*, that is, whether or not the subsequent sheet has arrived at the registration sensor 35*b*. When determining in S1304 that the subsequent sheet has not arrived at the registration sensor 35*b*, the conveyance control portion 221 returns to the processing of S1304. When determining in S1304 that the subsequent sheet has arrived at the registration sensor 35*b* (actually measured value 1253 in FIG. 12), the conveyance control portion 221 advances to the processing of 51305. In 51305, the conveyance control portion 221 calculates a difference time period $\Delta t_7'$ between the actually measured value (actually measured value 1253 in FIG. 12) of the registration sensor arrival time and the theoretical value (theoretical value 1263 in FIG. 12) thereof, and in 51306, starts the conveyance speed control based on the difference time period $\Delta t_7'$ (status 1283 of "third conveyance" in FIG. 12). In the image forming apparatus in which there is no conveyance variation between the pre-registration sensor 35*a* and the registration sensor 35*b*, the difference time period $\Delta t_7'$ becomes the difference time period $\Delta t_7$.

When determining in S1303 that the value of the difference time period $\Delta t_7$ does not satisfy (Expression 19), the conveyance control portion 221 starts the conveyance speed control based on the difference time period $\Delta t_7$ in S1307. That is, the conveyance control portion 221 determines that the conveyance variation amount cannot be corrected even if the conveyance speed control is performed at the maximum speed $V_{max}$ after the leading edge of the subsequent sheet has arrived at the registration sensor 35*b*, and starts the conveyance speed control from the pre-registration sensor 35*a*.

According to this embodiment, in the image forming apparatus for conveying the recording material from the start of the sheet feeding up to the arrival at the secondary transfer position by using one driving source in which the two recording material detection sensors are arranged in such positions that the distance therebetween is shorter than the image interval of the continuous printing, the following configuration is employed. That is, at least the conveyance speed control is carried out from the sensor on the upstream side (pre-registration sensor), and the conveyance speed control is carried out from the sensor on the downstream side (registration sensor) as much as possible. Accordingly, it is possible to secure more sections that enable correction of the acceleration and reduce the conveyance variation up to the sensor on the downstream side (registration sensor).

In this embodiment, the two recording material detection sensors are described by using the pre-registration sensor 35*a* as the sensor on the upstream side on the conveying path and the registration sensor 35*b* as the sensor on the downstream side. However, various changes can be made thereto based on the gist of the present invention and are not to be excluded from the scope of the present invention.

As described above, according to this embodiment, it is possible to obtain a satisfactory image while suppressing the conveyance variation of the subsequent sheet without affecting the conveyance of the preceding sheet or the image formation thereof and without lowering the productivity even when the recording materials are continuously conveyed by the same driving source.

Other Embodiment

The first to fourth embodiments are described by taking the case where the two rollers (cassette pickup roller 17 and registration roller 18) are driven by the same driving source. However, the present invention can also be applied to a structure in which more than two rollers provided between the sheet-feeding start position and the secondary transfer portion are driven by the same driving source. In this case, the conveyance speed control for the subsequent sheet is carried out at the timing at which the trailing edge of the preceding sheet passes through the roller located at the most downstream position among the plurality of rollers driven by the same driving source which are provided between the sheet-feeding start position and the secondary transfer portion.

The first to fourth embodiments are described by taking the example in which the conveyance speed control for the subsequent sheet is carried out by using the two recording material detection sensors (pre-registration sensor 35*a* and registration sensor 35*b*) provided between the sheet-feeding start position and the secondary transfer portion. However, the present invention can also be applied to a structure in which at least three recording material detection sensors are provided between the sheet-feeding start position and the secondary transfer portion. In this case, two recording material detection sensors among the plurality of recording material detection sensors may be used to detect the trailing edge of the preceding sheet by one recording material detection sensor and detect the leading edge of the subsequent sheet by the other recording material detection sensor.

In the first to fourth embodiments, the conveyance control portion 221 uses a detection result obtained by the recording material detection sensor to calculate the timing to start the conveyance speed control. However, the detection result obtained by the recording material detection sensor may be output to the CPU 211, and the CPU 211 may calculate the timing to start the conveyance speed control.

The first to fourth embodiments are described by taking the case of the two-sheet continuous printing, but the present invention can also be applied to the continuous printing more than two sheets.

The first to fourth embodiments are described by taking the example in which the conveyance speed control for the subsequent sheet is carried out by using the two recording material detection sensors (pre-registration sensor 35*a* and registration sensor 35*b*) provided between the sheet-feeding start position and the secondary transfer portion. However, the present invention may also be applied to a structure in which at least one sensor for detecting the leading edge and the trailing edge of the recording material is provided on the downstream side of the cassette pickup roller 17 and on the upstream side of the registration roller 18, that is, on the conveying path between the cassette pickup roller 17 and the registration roller 18. In this case, the distance between the registration roller 18 and the sensor (hereinafter referred to as "sensor A") provided between the cassette pickup roller 17 and the registration roller 18, and the conveyance speed of the recording material are known. Therefore, it is uniquely determined when the preceding sheet that has passed through the sensor A is to pass through the nip portion of the registration roller 18. That is, from the distance between the sensor A and the registration roller 18 and the conveyance speed (steady speed V) of the preceding sheet, it is possible to calculate a time period $T_A$ elapsed after the trailing edge of the preceding sheet passes through the sensor A until the trailing edge of the preceding sheet passes through the registration roller 18. Accordingly, for example, the timer (not shown) may be started when the trailing edge of the preceding sheet passes through the sensor A, and when the time period $T_A$ has elapsed, it is conceivable that the preceding sheet has passed through the nip portion of the registration roller 18. That is, based on the detection result obtained by the sensor A, the timing at which the preceding sheet passes through the registration roller 18 is predicted to carry out the conveyance speed control A. The other control is, for example, the same as that of the second embodiment.

The first to fourth embodiments are described by taking the image forming apparatus having the structure illustrated in FIG. 1, but the present invention can be applied to any image forming apparatus that performs the conveyance speed control for the recording material in order to adjust the timing to transfer the toner image onto the recording material. In this case, in the image forming apparatus for transferring the toner image on the photosensitive drum directly onto the recording material, the photosensitive drum corresponds to the image bearing member. In the image forming apparatus for transferring the toner image on the photosensitive drum onto the intermediate transfer belt and transferring the toner image on the intermediate transfer belt onto the recording material, the intermediate transfer belt corresponds to the image bearing member.

According to the other embodiments, it is possible to obtain a satisfactory image while suppressing the conveyance variation of the subsequent sheet without affecting the conveyance of the preceding sheet or the image formation thereof and without lowering the productivity even when the recording materials are continuously conveyed by the same driving source.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional Application of U.S. application Ser. No. 13/962,230, was filed on Aug. 8, 2013, and which claims the benefit of Japanese Patent Application No. 2012-184410, filed Aug. 23, 2012, which are hereby incorporated by reference herein in their entireties.

What is claimed is:

1. An image forming apparatus comprising:

a storage portion configured to store recording materials;

a first conveyance portion configured to convey a recording material;

a first detection unit provided on a downstream side of the first conveyance portion in a conveying direction of the recording material and configured to detect a leading edge of the recording material;

a second conveyance portion provided on a downstream side of the first detection unit in the conveying direction and configured to convey the recording material;

a second detection unit provided on a downstream side of the second conveyance portion in the conveying direction and configured to detect the leading edge of the recording material;

a drive source driving the first conveyance portion and the second conveyance portion;

a control unit controlling the drive source based on a detecting result obtained by at least one of the first detection unit and the second detection unit, wherein a first recording material and a second recording material which is conveyed subsequently to the first recording material are conveyed from the storage portion so that a distance between a trailing edge of the first recording material and a leading edge of the second recording material in a conveyance path is a first predetermined distance longer than a distance between the first detection unit and the second detection unit in the conveyance path, in a case that the detecting result, which is obtained by detecting the leading edge of the second recording material with the first detection unit after the trailing edge of the first recording material passes through the first detection unit, indicates a state where the distance between the trailing edge of the first recording material and the leading edge of the second recording material is longer than the first predetermined distance and the distance between the trailing edge of the first recording material and the leading edge of the second recording material is shorter than a second predetermined distance which is longer than the first predetermined distance, the control unit controls the drive source to change a conveyance speed of the second recording material from a predetermined speed to a faster speed according to a timing when the second detection unit detects the leading edge of the second recording material, and in a case that the detecting result, which is obtained by detecting the leading edge of the second recording material with the first detection unit after the trailing edge of the first recording material passes through the first detection unit, indicates a state where the distance between the trailing edge of the first recording material and the leading edge of the second recording material is longer than the second predetermined distance, the control unit controls the drive source to change the conveyance speed of the second recording material from the predetermined speed to a faster speed according to the timing when the first detection unit detects the leading edge of the second recording material.

2. The image forming apparatus according to claim 1, wherein in the case that the detecting result, which is obtained by detecting the leading edge of the second recording material with the first detection unit after the trailing edge of the first recording material passes through the first detection unit, indicates the state where the distance between the trailing edge of the first recording material and the leading edge of the second recording material is longer than the first predetermined distance and shorter than the second predetermined distance, the control unit calculates the conveyance speed and a conveyance time of the second recording material based on the timing when the second detection unit detects the leading edge of the second recording material, and the control unit controls the drive source to convey the second recording material at the calculated conveyance speed for the calculated conveyance time, and in the case that the detecting result, which is obtained by detecting the leading edge of the second recording material with the first detection unit after the trailing edge of the first recording material passes through the first detection unit, indicates the state where the distance between the trailing edge of the first recording material and the leading edge of the second recording material is longer than the second predetermined distance, the control unit calculates that conveyance speed and the conveyance time of the second recording material based on the timing when the first detection unit detects the leading edge of the second recording material, and the control unit controls the drive source to convey the second recording material at the calculated conveyance speed for the calculated conveyance time.

3. The image forming apparatus according to claim 2, wherein, in the case that the detecting result, which is obtained by detecting the leading edge of the second recording material with the first detection unit after the trailing edge of the first recording material passes through the first detection unit, indicates the state where the distance between the trailing edge of the first recording material and the leading edge of the second recording material is longer than the first predetermined distance and shorter than the second predetermined distance, the control unit controls the drive source from the timing when the second detection unit detects the leading edge of the second recording material to start changing the conveyance speed of the second recording material, and in the case that the detecting result, which is obtained by detecting the leading edge of the second recording material with the first detection unit after the trailing edge of the first recording material passes through the first detection unit, indicates the state where the distance between the trailing edge of the first recording material and the leading edge of the second recording material is longer than the second predetermined distance, the control unit controls the drive source from the timing when the first detection unit detects the leading edge of the second recording material to start changing of the conveyance speed of the second recording material.

4. The image forming apparatus according to claim 1, further comprising:

an image bearing member; and a transferring unit transferring an image to be formed on the image bearing member onto a recording material, wherein the predetermined speed is a speed at which the recording material is conveyed at the transferring unit.

5. The image forming apparatus according to claim 4, wherein the second predetermined distance is a distance which can be corrected by conveying the second recording material at a maximum conveyance speed in a section of the conveyance path from the first detection unit to the transferring unit when conveying the first recording material at the predetermined speed.

6. The image forming apparatus according to claim 4, wherein in a case that the detecting result, which is obtained by detecting the leading edge of the second recording material with the first detection unit after the trailing edge of the first recording material passes through the first detection unit, indicates a state where the distance between the trailing edge of the first recording material and the leading edge of the second recording material is different from the first predetermined distance, the control unit controls the drive source to convey the second recording material at a different speed from the predetermined speed so that the trailing edge of the first recording material and the leading edge of the second recording material matches with the first predetermined distance at the transferring unit.

7. An image forming apparatus comprising:

a conveyance portion configured to convey a recording material;

a first detection unit configured to detect arrival of the recording material;

a second detection unit provided on a downstream side of the first detection unit in a conveying direction of the recording material and configured to detect arrival of the recording material;

a drive source configured to drive the conveyance portion; and a control unit configured to control the drive source based on a detecting result obtained by at least one of the first detection unit and the second detection unit, wherein, in a case that a time difference length between a reference timing and a timing when the first detection unit detects the recording material is shorter than a predetermined time length, the control unit controls the drive source to change a conveyance speed of the recording material according to a timing when the second detection unit detects the recording material, and in a case that the time difference length is longer than the predetermined time length, the control unit controls the drive source to change the conveyance speed of the recording material according to the timing when the first detection unit detects the recording material.

8. The image forming apparatus according to claim 7, wherein, in a case that the timing when the first detection unit detects the recording material is later than the reference timing and the time difference length is shorter than the predetermined time length, the control unit controls the drive source to change the conveyance speed of the second recording material from a predetermined speed to a faster speed according to the timing when the second detection unit detects the recording material, and in a case that the timing when the first detection unit detects the recording material is later than the reference timing and the time difference length is longer than the predetermined time length, the control unit controls the drive source to change the conveyance speed of the second recording material from the predetermined speed to a faster speed according to the timing when the first detection unit detects the recording material.

9. The image forming apparatus according to claim 8, wherein, in the case that the timing when the first detection unit detects the recording material is later than the reference timing and the time difference length is shorter than the predetermined time length, the control unit calculates the conveyance speed and a conveyance time of the recording material based on the timing when the second detection unit detects the recording material, and the control unit controls the drive source to convey the recording material at the calculated conveyance speed for the calculated conveyance time, and in the case that the timing when the first detection unit detects the recording material is later than the reference timing and the time difference length is longer than the predetermined time length, the control unit calculates that conveyance speed and the conveyance time of the second recording material based on the timing when the first detection unit detects the recording material, and the control unit controls the drive source to convey the recording material at the calculated conveyance speed for the calculated conveyance time.

10. The image forming apparatus according to claim 9, wherein, in the case that the timing when the first detection unit detects the recording material is later than the reference timing and the time difference length is shorter than the predetermined time length, the control unit controls the drive source from the timing when the second detection unit detects the recording material to start changing the conveyance speed of the recording material, and in the case that the timing when the first detection unit detects the recording material is later than the reference timing and the time difference length is longer than the predetermined time length, the control unit controls the drive source from the timing when the first detection unit detects the recording material to start changing of the conveyance speed of the recording material.

11. The image forming apparatus according to claim 7, further comprising:

an image bearing member; and a transferring unit transferring an image to be formed on the image bearing member onto a recording material, wherein the predetermined speed is a speed at which the recording material is conveyed at the transferring unit.

12. The image forming apparatus according to claim 11, wherein the predetermined time length is a time length corresponding to a distance which can be corrected by conveying the recording material at a maximum conveyance speed in a section of the conveyance path from the second detection unit to the transferring unit.

13. The image forming apparatus according to claim 11, wherein in a case that the timing when the first detection unit detects the recording material is different from the reference timing, the control unit controls the drive source to convey the recording material at a different speed from the predetermined speed so that the image formed on the image bearing member is transferred onto the recording material by the transferring unit.

* * * * *